US006669292B2

(12) United States Patent
Koepke et al.

(10) Patent No.: US 6,669,292 B2
(45) **Date of Patent: *Dec. 30, 2003**

(54) ERGONOMIC CHAIR

(75) Inventors: Marcus C. Koepke, Indianapolis, IN (US); Jamie Krull, Coralville, IA (US); Jay R. Machael, Muscatine, IA (US); Tim Coffield, Grand Rapids, MI (US); Keith L. Davis, Wilton, IA (US); Amin K. Habboub, Muscatine, IA (US); Matthew J. Phillips, Muscatine, IA (US); Douglas A. Schroeder, Muscatine, IA (US); Craig H. Schultz, Muscatine, IA (US); Erik A. Steffensen, Iowa City, IA (US); Brian R. Trego, Muscatine, IA (US); Eric M. Zillig, Muscatine, IA (US)

(73) Assignee: HON Technology Inc., Muscatine, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/077,409

(22) Filed: Feb. 15, 2002

(65) Prior Publication Data

US 2003/0001420 A1 Jan. 2, 2003

Related U.S. Application Data

(63) Continuation-in-part of application No. 09/882,237, filed on Jun. 15, 2001.

(51) Int. Cl.[7] ..... A47C 1/024; A47C 3/026

(52) U.S. Cl. ..... 297/300.2; 297/300.1; 297/322

(58) Field of Search ..... 297/300.2, 300.1, 297/322

(56) References Cited

U.S. PATENT DOCUMENTS

| | | | | |
|---|---|---|---|---|
| 4,783,121 A | | 11/1988 | Luyk et al. | 297/300.2 |
| 4,877,291 A | | 10/1989 | Taylor | 297/322 X |
| 5,251,958 A | | 10/1993 | Roericht et al. | 297/322 X |
| 5,318,345 A | | 6/1994 | Olson | 297/300.5 |
| 5,366,274 A | | 11/1994 | Roericht et al. | 297/321 |
| 5,860,701 A | | 1/1999 | Jungjohann et al. | 297/300.2 X |
| 6,109,694 A | * | 8/2000 | Kurtz | 297/300.2 |
| D443,425 S | | 6/2001 | Pomeroy et al. | |

* cited by examiner

*Primary Examiner*—Rodney B. White
(74) *Attorney, Agent, or Firm*—Joseph H. Golant; Jones Day

(57) ABSTRACT

An ergonomic chair includes a four-bar linkage arrangement wherein a lower frame member is provided with a rigid front support and a rigid rear support with a seat member pivotably connected to the front support. A back rest has an upper support pivotably connected at an upper end of the rear support of the lower frame member. A link member pivotably connects at a first end to a rear support of the seat member and at second end to a lower support of the back rest. This novel arrangement permits tilting movement of the backrest rearwardly relative to the lower frame member causing elevation of a rear portion of the seat member, permitting the feet to remain on the floor and alleviating pressure on the user's thighs, while rotation occurs closely coincident with the pivot axis of the user's hips and while maintaining a generally uniform gaze line.

30 Claims, 38 Drawing Sheets

VIEW FROM FRONT

VIEW FROM BACK

ERGONOMIC CHAIR

RELATED APPLICATIONS

This application claims the benefit of an earlier filing date and is a continuation-in-part of pending U.S. application, Application No. 09/882,237, filed Jun. 15, 2001, entitled *ERGONOMIC CHAIR*, the disclosure of which is incorporated herein in full by reference.

BACKGROUND OF THE INVENTION

1. Field of the Invention

The present invention relates generally to a chair of the type suitable for use in an office environment and, more particularly, to a reclining office chair having several structural and operating features which offer a number of ergonomic and other advantages over the prior art.

2. Description of the Related Art

Over many years attempts have been made to design chairs for use in office environments which are comfortable to use and thereby avoid user fatigue over prolonged use. In one simple form a chair may be provided with a swivel base for ease of turning and include a control mechanism which permits the chair to rock. A disadvantage of these relatively simple chairs is that conjoint rocking motion of the chair seat and back naturally lifts the user's feet off the floor, which can create stability problems and place upward force on the front of the user's thighs which can reduce fluid circulation in the user's legs.

To improve on the foregoing chair construction, chair controls are known which provide for synchronous movement of the chair seat and back. Where office chairs are concerned, a "synchronous control" means the arrangement of a combined or dependent back adjustment and seat adjustment, that is to say the adjustment of the back inclination fundamentally also results in an adjustment of the sitting surface. An example of a synchronous chair control is disclosed in U.S. Pat. No. 5,318,345, issued to Olson and assigned to the common assignee herein. With the aforementioned Olson control, the chair back is designed to tilt at one predetermined rate of recline while the seat tilts synchronously at a much lesser rate. The result is that the user's feet are not lifted from the floor when the back is reclined. Also, fluid circulation in the user's legs is not interrupted by substantial upward movement of the forward end of the seat. Another advantage of this control is that undesirable "shirt pull" is minimized by the strategic location of the tilt axis. Other examples of synchronous chair controls are disclosed in U.S. Pat. Nos. 5,366,274 and 5,860,701, to name a few.

In U.S. Pat. No. 6,125,521, it is disclosed to be desirable to provide a chair having a seat and backrest which pivot generally about the axis of the hip joints of the user. A disadvantage of that chair is that as the chair back reclines, the rear of the seat also tilts downwardly, having the effect of changing the user's gaze angle. Further, in that chair, the arms also tilt with the chair back, thus displacing the user's arms away from any work surface. In U.S. Pat. No. 5,979,984, the seat is arranged to both slide forwardly and the rear portion of the seat moves downwardly as the back reclines.

Another feature embodied in recently designed office chairs that offers considerable ergonomic advantages is a tilt limiter feature for the chair back. With such a mechanism built into the chair control, the user may selectively set the degree of back recline at a predetermined angle thereby adding to comfort as the chair is used. An example of such a tilt limiter mechanism is disclosed in U.S. Pat. No. 6,102,477 issued to Kurtz and assigned to the common assignee herein. This particular mechanism offers the advantage of providing for infinitely variable angles of tilt within a predetermined overall range. The mechanism is also highly cost-effective to construct.

Yet another feature of current ergonomically designed chairs is the provision of height and pivot adjustable arm pads. Such a feature is particularly advantageous in providing the user with additional support to the arms, forearms, wrists and shoulders in order to minimize repetitive stress injuries when the user is keyboarding, for example, while seated in the chair. An example of such an adjustable arm pad using a gas cylinder is disclosed in U.S. Pat. No. 5,908,221 issued to Neil.

Yet another feature of current ergonomically designed office chairs includes an adjustable lumbar support mechanism for providing preselected chair back tension in the region of the user's lower back. An adjustable lumbar support allows the chair user to select a comfortable level of pressure on the lower back depending upon the specific office task being performed. Such a mechanism is disclosed, for example, in U.S. Pat. No. 5,797,652.

Still another feature of certain ergonomically designed office chairs, particularly of recent vintage, is the incorporation of fabric mesh into the construction of the chair seat, and/or back. These materials ostensibly offer the advantage of enhanced air circulation for and consequent heat transfer from the chair user's body, which can improve the comfort of the chair. An example of the use of such fabric mesh in an office chair is disclosed in aforementioned U.S. Pat. No. 6,125,521 issued to Stumpf et al.

Yet another feature of certain ergonomically designed chairs is the provision of a seat cushion having the capability of effecting heat transfer from the chair user's buttocks area while at the same time offering comfort to the user while seated, together with adequate support. Known seat cushions having such capability may involve a passive or active air flow circulation feature of the type disclosed, for example, in U.S. Pat. No. 6,179,706.

SUMMARY OF THE INVENTION

The present invention provides a totally redesigned ergonomic chair that incorporates simple but improved functional and esthetic aspects in all areas of a modular chair construction and in its use, including synchronous tilt of back and seat; tilt limit control; separate seat adjustment; arm adjustment; adjustable lumbar support; cushion airflow; mesh attachment and modular base frame assembly.

The various subfeatures of these various components are the subject of the following individual applications, the parent applications of each of which were filed on the same date as the parent application of the present case, the continuation-in-part applications being filed on even date herewith, all commonly assigned, the disclosures of all of which are incorporated herein in fall by reference:

- Multi-position Tilt Limiting Mechanism U.S. Ser. No. 09/882,500, filed Jun. 15, 2001
- Locking Device for Chair Seat Horizontal Adjustment Mechanism U.S. Ser. No. 09/881,896, filed Jun. 15, 2001 and Adjustable Chair Seat Locking Mechanism Continuation-in-part application, Application No. 10/077,313, filed on even date herewith
- Height and Pivot-Adjustable Chair Arm U.S. Ser. No. 09/881,818, filed Jun. 15, 2001 and Vertically and Horizontally Adjustable Chair Armrest—Continuation-in-part application, Application No. 10/077,073, filed on even date herewith Lumbar Support for a Chair U.S. Ser. No. 09/881,795, filed Jun. 15, 2001

Body Support Member U.S. Ser. No. 09/882,503, filed Jun. 15, 2001 Continuation-in-part application, Application No. 10/172,699, filed Jun. 14, 2002

Chair Back Construction U.S. Ser. No. 09/882,140, filed Jun. 15, 2001 and Chair Back Construction—Continuation-in-part application, Application No. 10/077,540, filed on even date herewith Chair of Modular Construction U.S. Ser. No. 09/881,897, filed Jun. 15, 2001

In each of these cases, features combine to provide an overall chair that is a significant improvement over the prior art.

Thus, for example, the present invention provides a reclining chair having a four bar linkage system that causes the rear of the seat to elevate as the back is reclined lending an unusual and comfortable balance during reclining. A very simple and economically constructed tilt limit control conveniently and effectively limits the degree of chair back tilt to one of several reclined positions by manual movement of a lever. Horizontal positioning of the chair seat cushion may be accomplished using a simple but positive locking device that allows the chair user to select a preferred horizontal seat cushion position. Height and pivot adjustable chair arms are simply and positively actuated with the push of a button or simple rotation, lending convenient adjustment to suit a specific work task. A lumbar support is easily height adjustable, by providing tension to the back frame and requires no screws or adjustment knobs in its adjustment mechanism, and also does so by avoiding direct contact of the lumbar support with the back of the user. A modular cushion seat includes a comfortable thermal air flow layer and gel layer which is vented uniquely for air circulation and stress and pressure management. The back of the chair is of fabric mesh construction and includes a novel attachment system for superior comfort. The base and back of the chair are of modular construction that provides for ease of assembly and lends rigidity to the chair construction, and in which an open skeletal frame structure displays both the simplicity of the chair structure while adding to its esthetic appeal.

A primary object of the present invention is a tiltable chair wherein users of substantially all weights and sizes may be continuously balanced in the chair at any selected reclination position, therefore enhancing both "fit" and "comfort." The present invention improves over the prior art by providing an ergonomic chair having a four-bar linkage arrangement wherein a lower frame member is provided with a rigid front support and a rigid rear support with a seat member pivotably connected to the front support. A back rest has a first pivot point connected at an upper end of the rear support of the lower frame member. A link member pivotably connects at a first end to a rear support of the seat member and at a second end to a second, lower pivot point on the back rest. This novel arrangement permits tilting movement of the backrest rearwardly relative to the lower frame member while concurrently causing elevation of a rear portion of the seat member, permitting the feet to remain on the floor and alleviating pressure on the user's thighs. This is accomplished by a linkage mechanism creating an instantaneous center of rotation of the chair seat and back that is approximately at the user's hip, so that the movement of the seat and back reduces undesirable "shirt pull." This arrangement also is more responsive to the user and provides correct back support throughout tilt.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENTS

Figure 1:
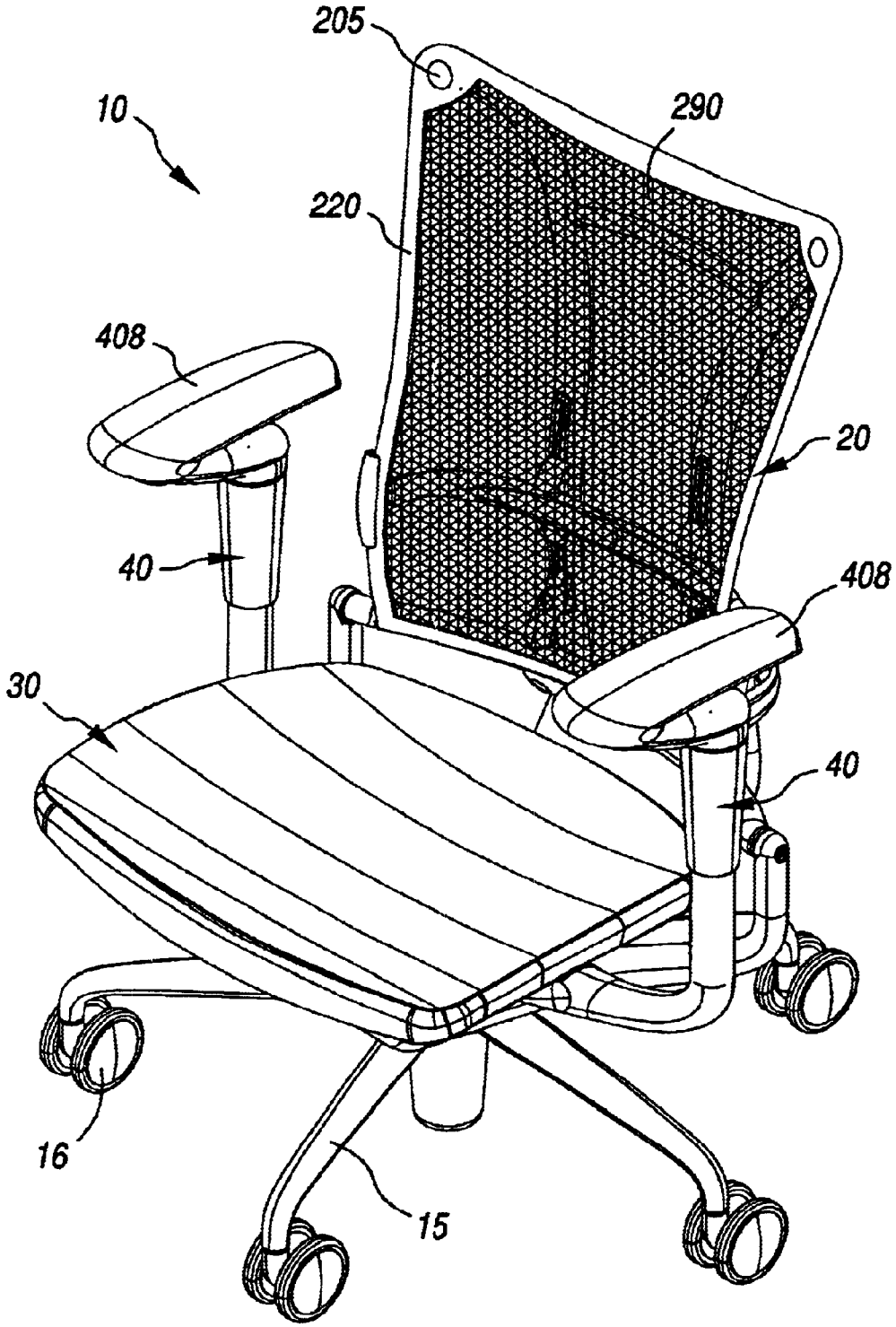
FIG. 1 is a left front perspective view of an ergonomic chair constructed in accordance with the principles of the invention and incorporating all of the improved modular components.
Figure 2:
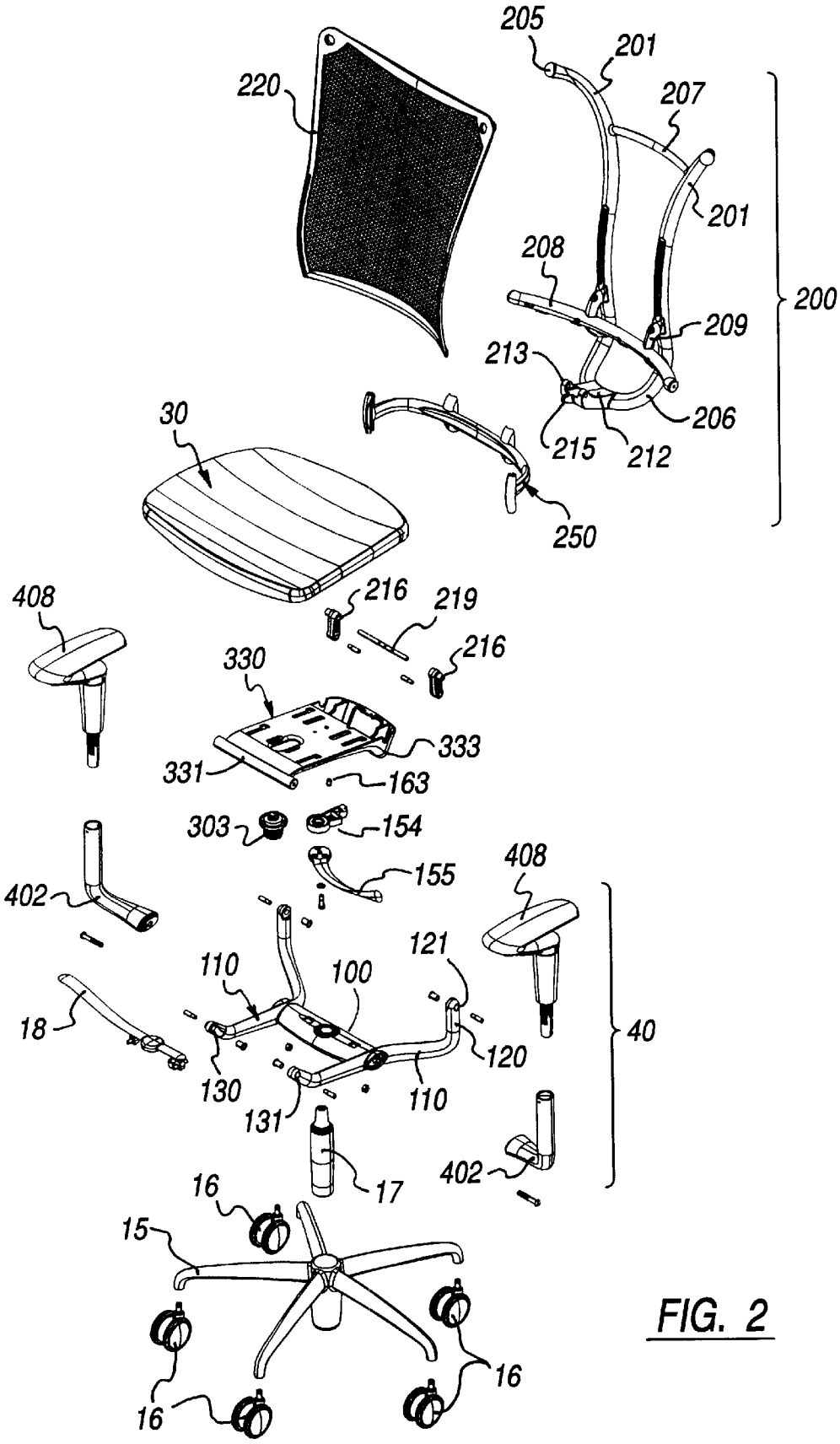
FIG. 2 is an exploded perspective view of the ergonomic chair shown in FIG. 1.

Referring now to the drawings, and initially to FIGS. 1 and 2, an improved ergonomic chair constructed in accordance with the numerous principles of the invention is shown and designated generally by the reference numeral 10. The chair 10 comprises as its principal components a back 20 and seat 30. Suitable armrest assemblies 40 having upper armrest pads 408 may be provided. The chair 10, in a conventional manner, may be supported on a spider base 15 movable on casters 16.

Figure 4A:
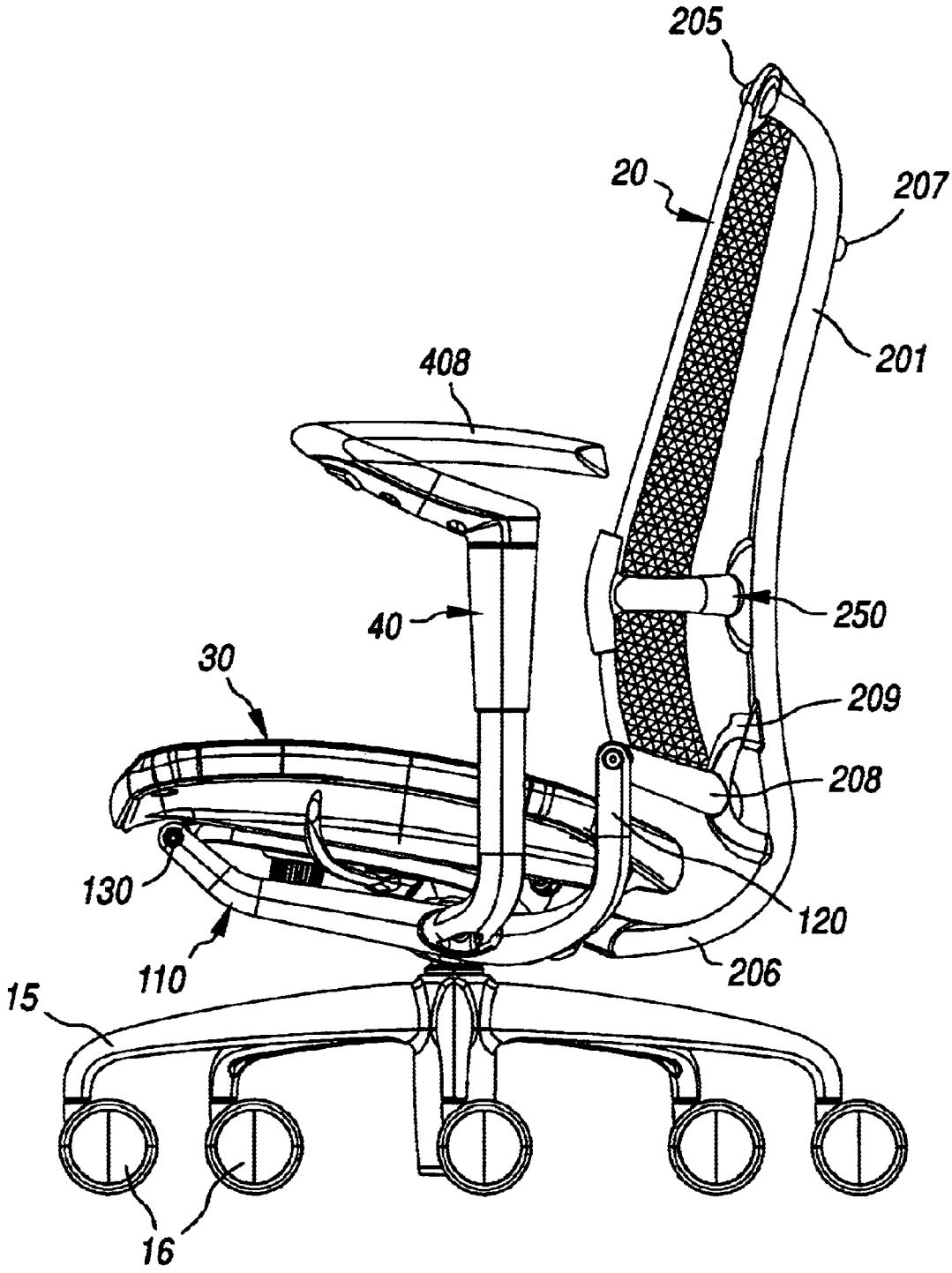
FIG. 4*a* is a left side view of the ergonomic chair of FIG. 1.
Figure 4B:
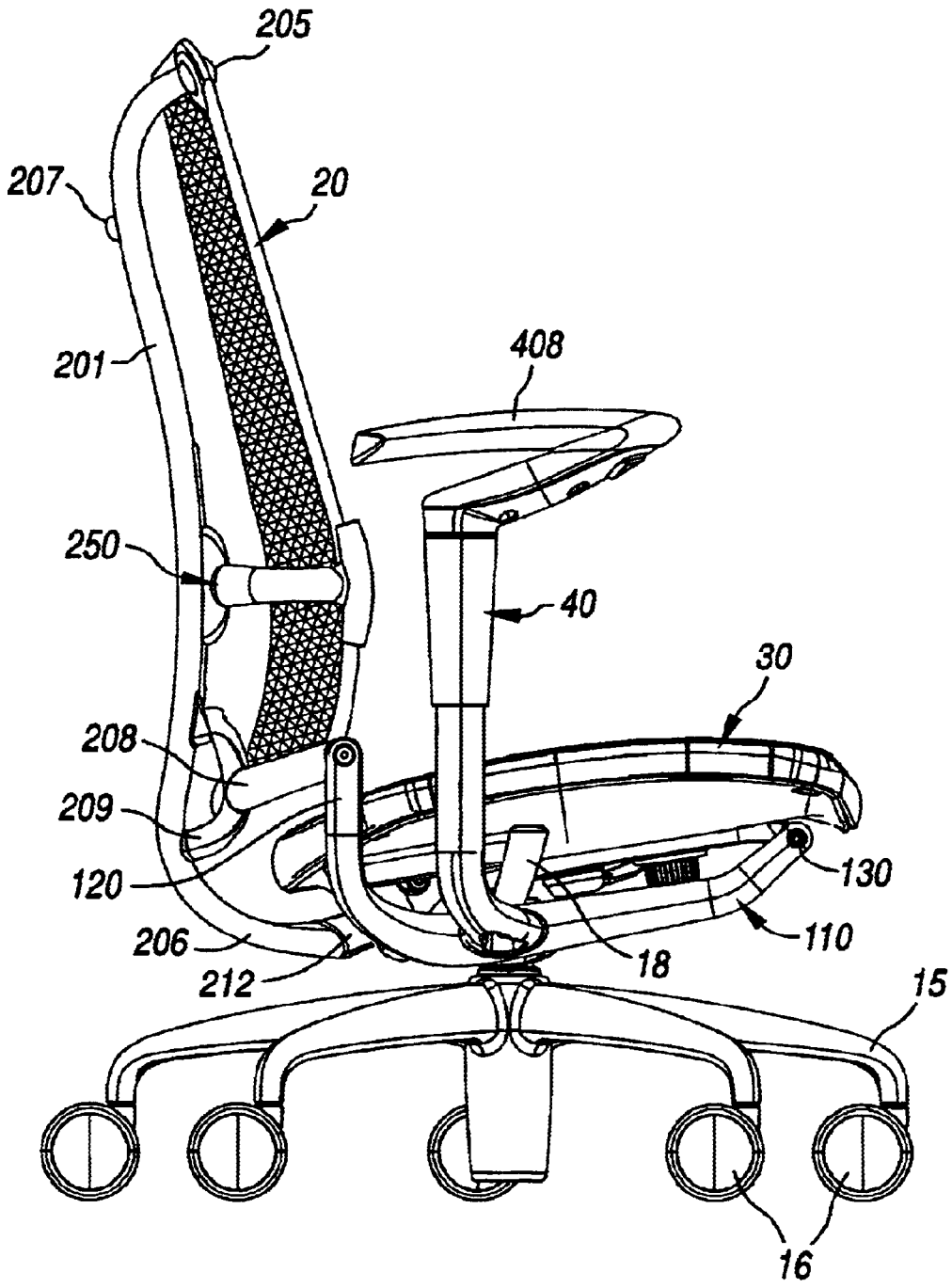
FIG. 4*b* is a right side view of the ergonomic chair of FIG. 1.
Figure 5:
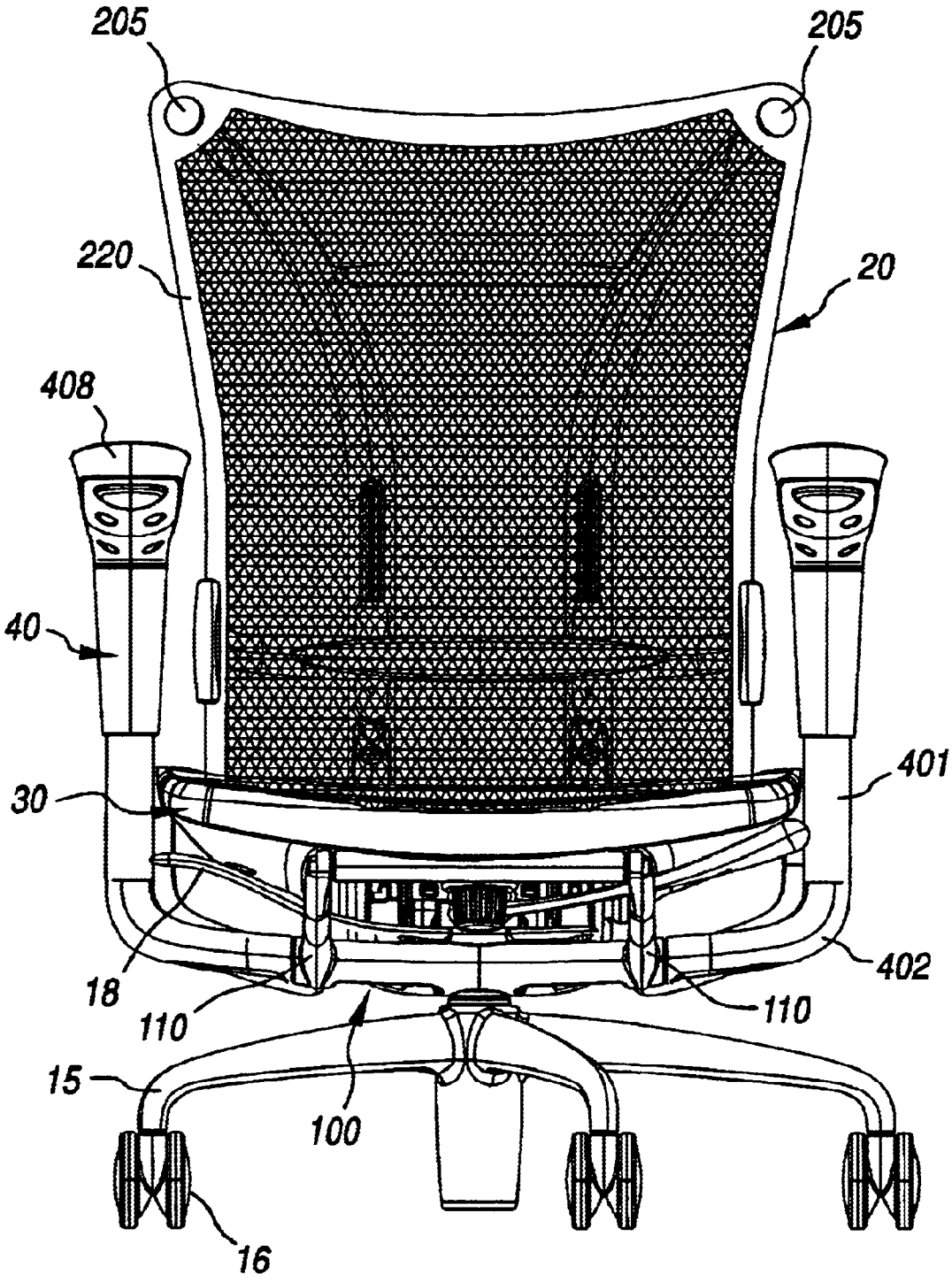
FIG. 5 is a front view of the ergonomic chair of FIG. 1.
Figure 6:
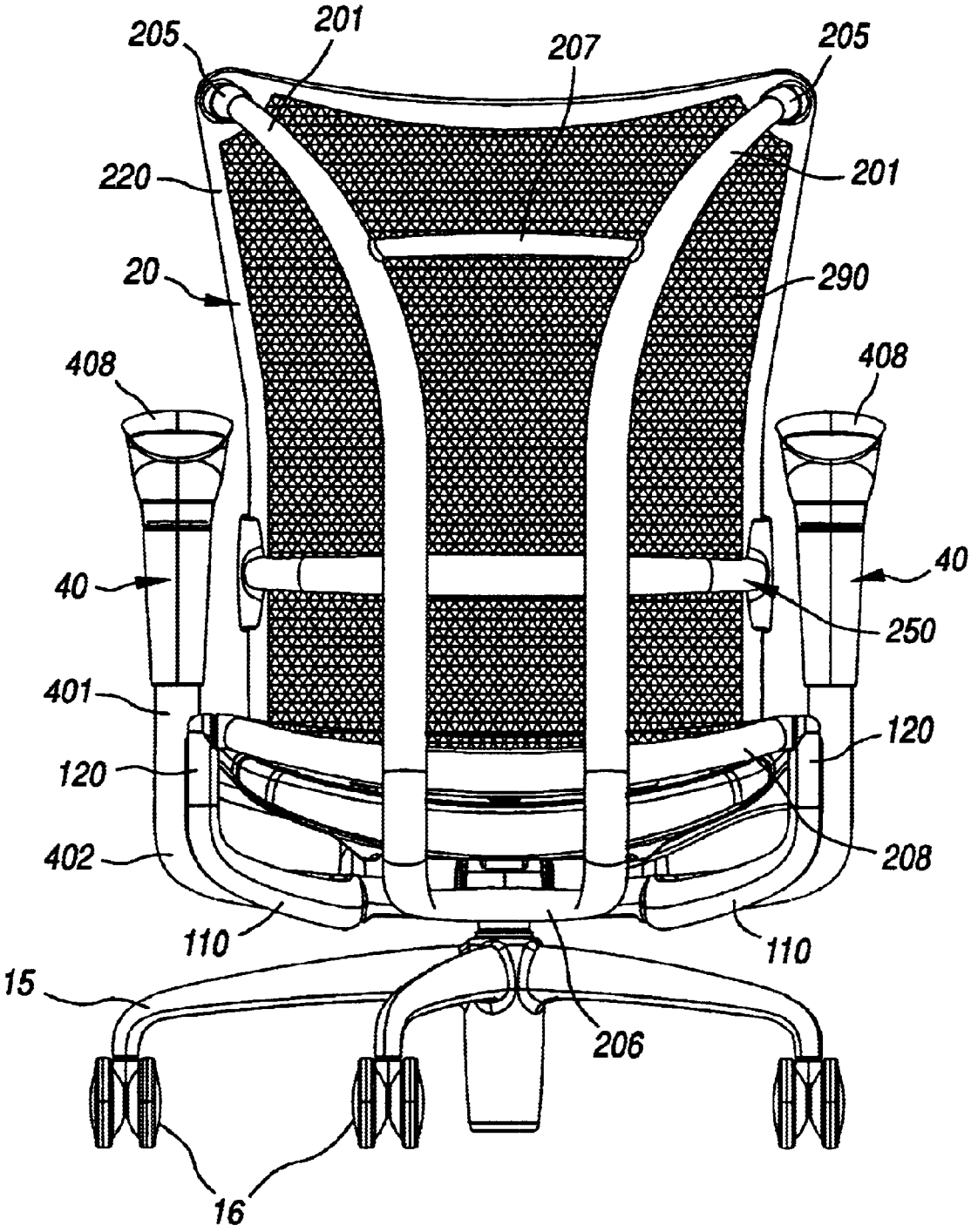
FIG. 6 is a rear view of the ergonomic chair of FIG. 1.
Figure 10:
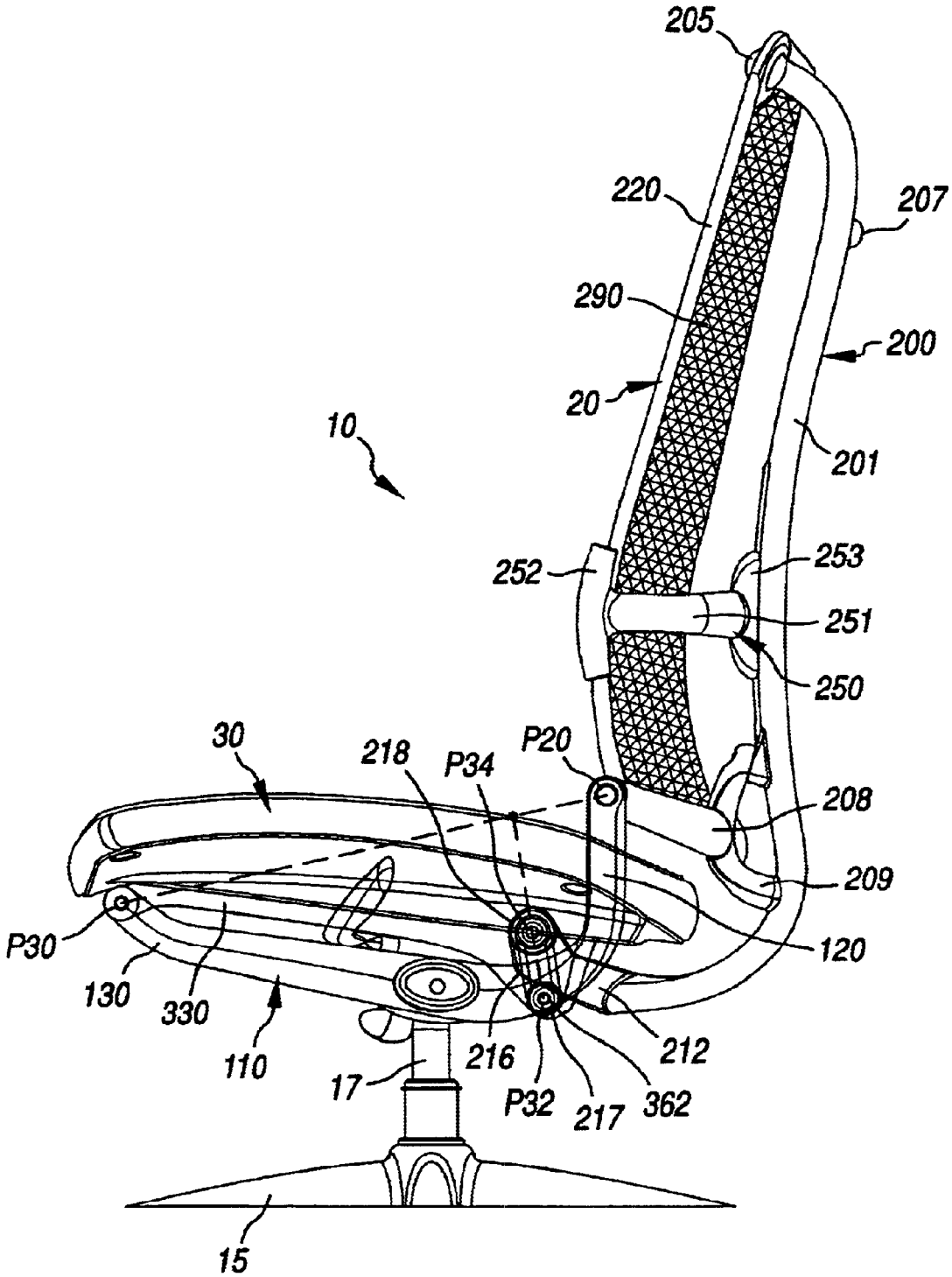
FIG. 10 is a partial left side view illustrating the ergonomic chair of FIG. 1 in a fully upright position.
Figure 11:
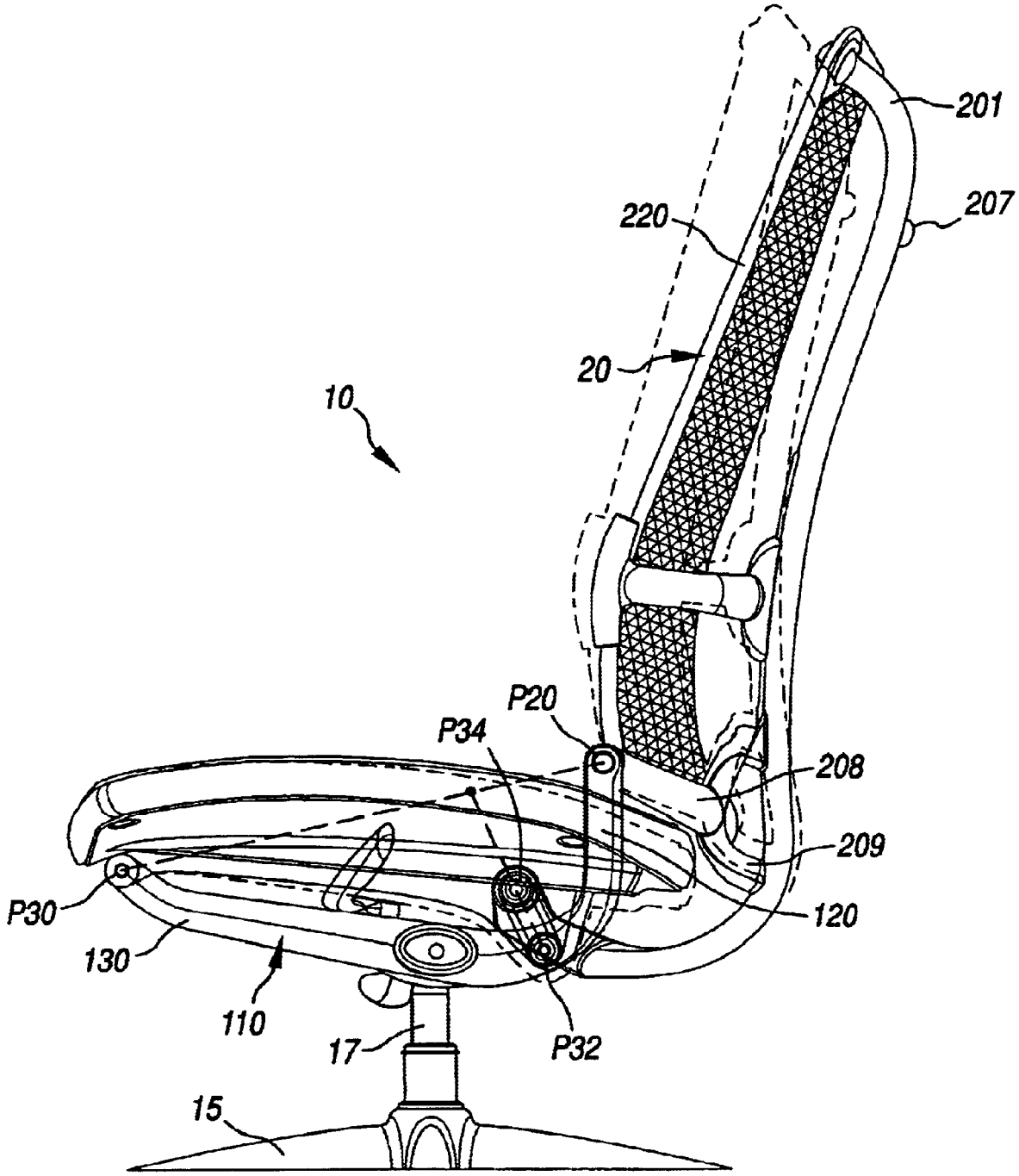
FIG. 11 is a partial left side view of the ergonomic chair of FIG. 1 shown in a partially reclined position.
Figure 12:
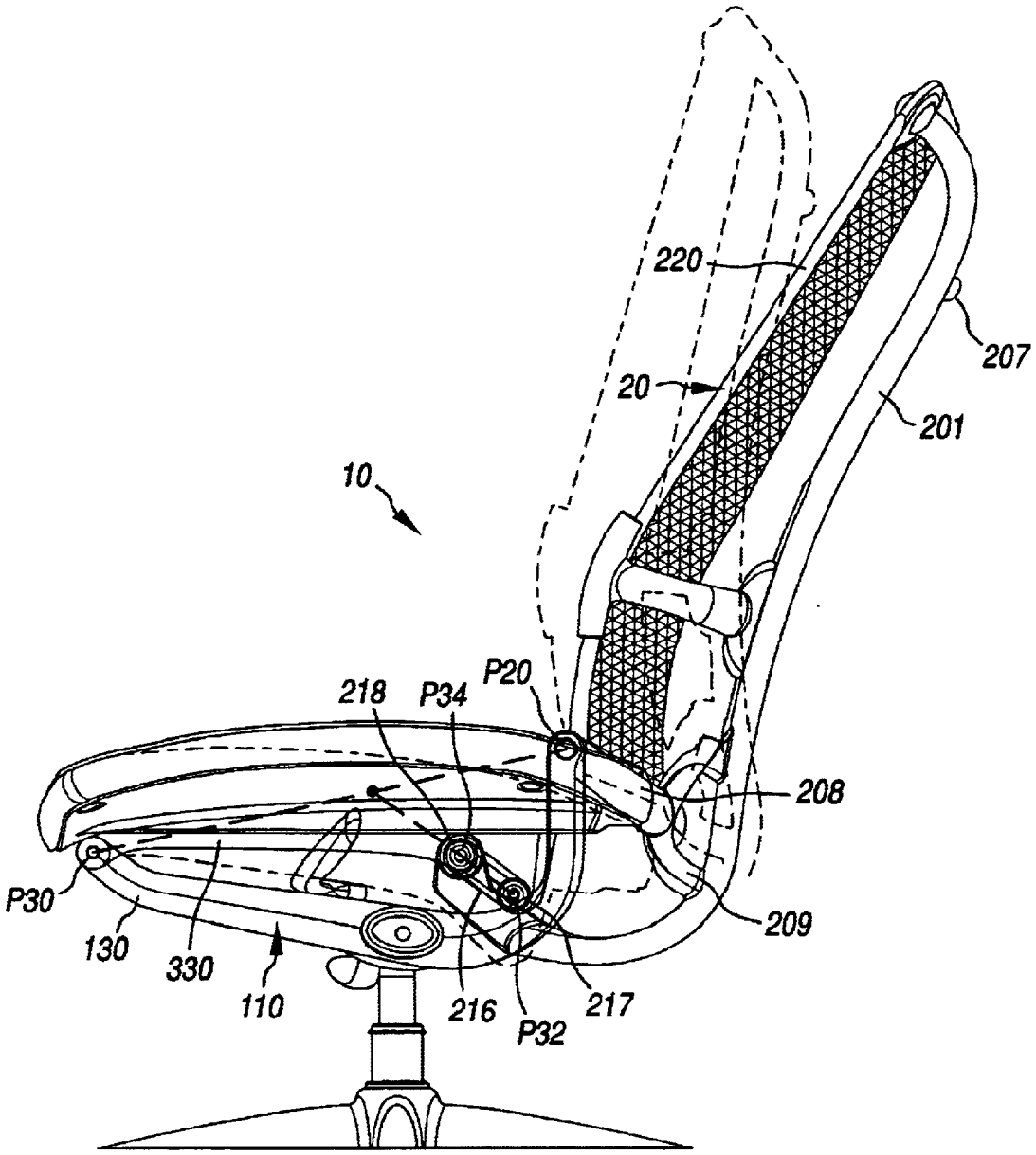
FIG. 12 is a partial left side view of the ergonomic chair of FIG. 1 shown in a fully reclined position.

As shown in FIGS. 10–12, the chair 10 is so constructed as to have synchronous movement of the back 20 and seat 30. The modular chair construction generally is described in greater detail in aforesaid copending application Ser. No. 09/881,897, incorporated herein by reference. The chair 10 receives the upper end of a gas cylinder 17. The gas cylinder 17 is preferably a two-stage type available from Stabilus GmbH of Germany. This cylinder 17 is operable by a manually pivotable lever arm 18. FIGS. 2 and 4*b*, which activates the cylinder 17 for height and adjustability of the chair 10 in a manner well-known in the art, the advantage in this case is that movement of the arm 18 in either up or down direction effects movement of the cylinder to either direction.

For purposes of clarity of discussion only, the chair 10 will be described and claimed with reference to up, down, left and right and forward and rear as though a user were seated on the chair, but without intent to limit the claims except where apparent. Further, because many of the parts are identical but are mirror images in arrangement, the same part number will be used to describe like parts but with an "L" or "R" designation for the left or right side used only as and when necessary.

The chair 10 is formed of modular construction. It has a central base or support module 100, FIG. 3. The module 100 has a mounting section 101 extending transversely. The mounting section 101 forms a support which receives elongated seat and back frame support members 110. Armrest modules or assemblies 40 are attached at the ends of the central base member 100 by bolts 490 and hidden nuts 491. The lower curved end portion 402 of each of the arm rest modules 40 is positioned on the mounting section 101 and extends past each end of the first and second elongated seat and back support modules 110.

The armrest modules 40 have upper end portions 401 to which armrests 408, FIG 4*a*, may be attached, as hereinafter described.

Figure 3:
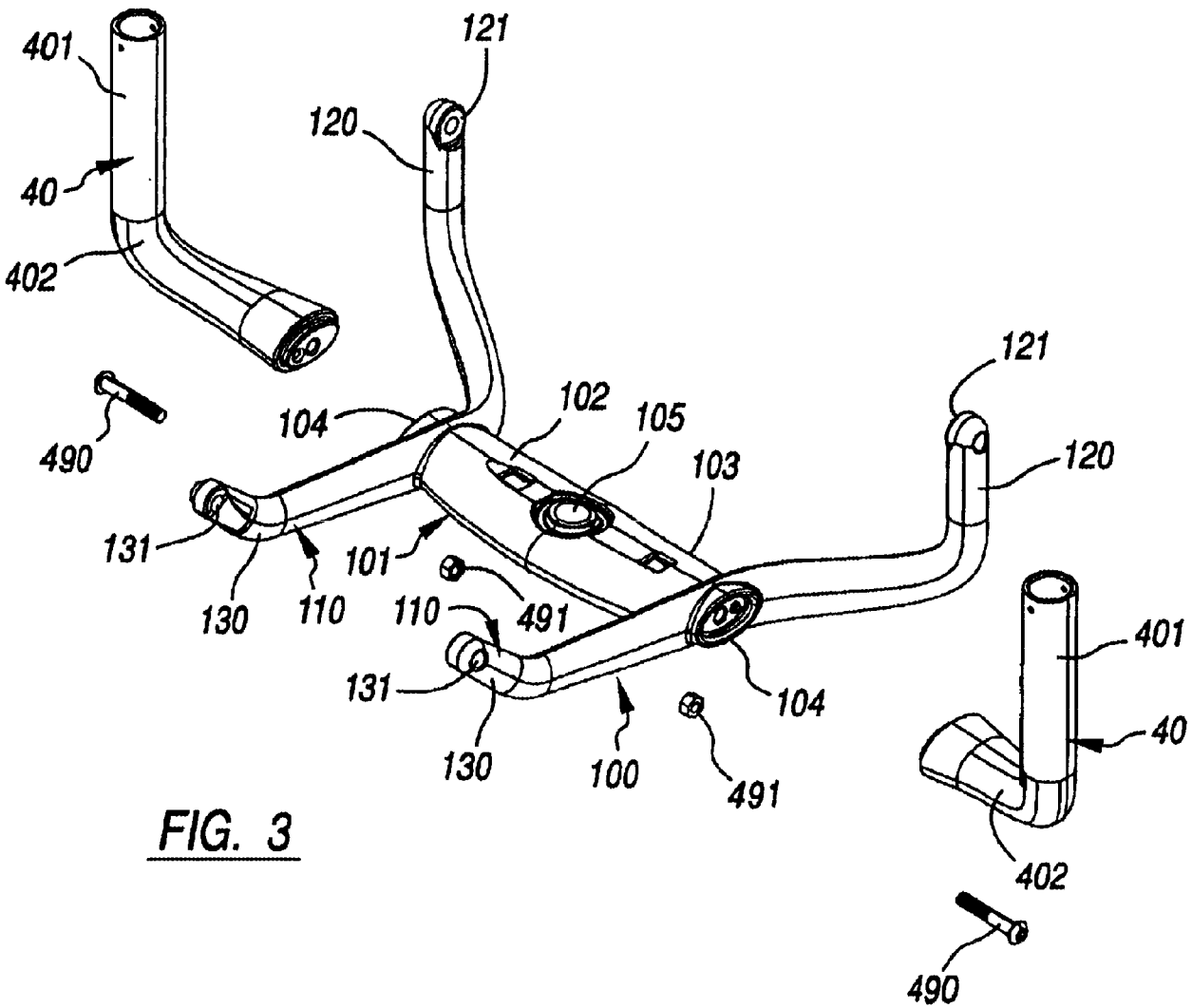
FIG. 3 is an exploded perspective view providing more details of a central support module of the ergonomic chair shown in FIG. 1.

FIG. 3 is a front isometric view of the central base module 100 illustrating the top 102 and bottom 103 thereof as well as the opposing ends 104 thereof. A hub opening 105 is provided for securing the central base to the top of the piston/cylinder arrangement 17.

Each elongated seat and back frame support member 110 has a front seat member support end 130 and a rear backrest frame support end 120. As can be observed, the rear ends 120 are separated at a greater lateral distance than the front ends 130 and the front ends 130 are at a lower elevation than the rear ends 120. Each of the ends 120 and 130 form pivots at apertures 121 and 131, respectively, therethrough for receiving appropriate pivot pins 122, 123, 132, 133, FIG. 2.

Figure 9:
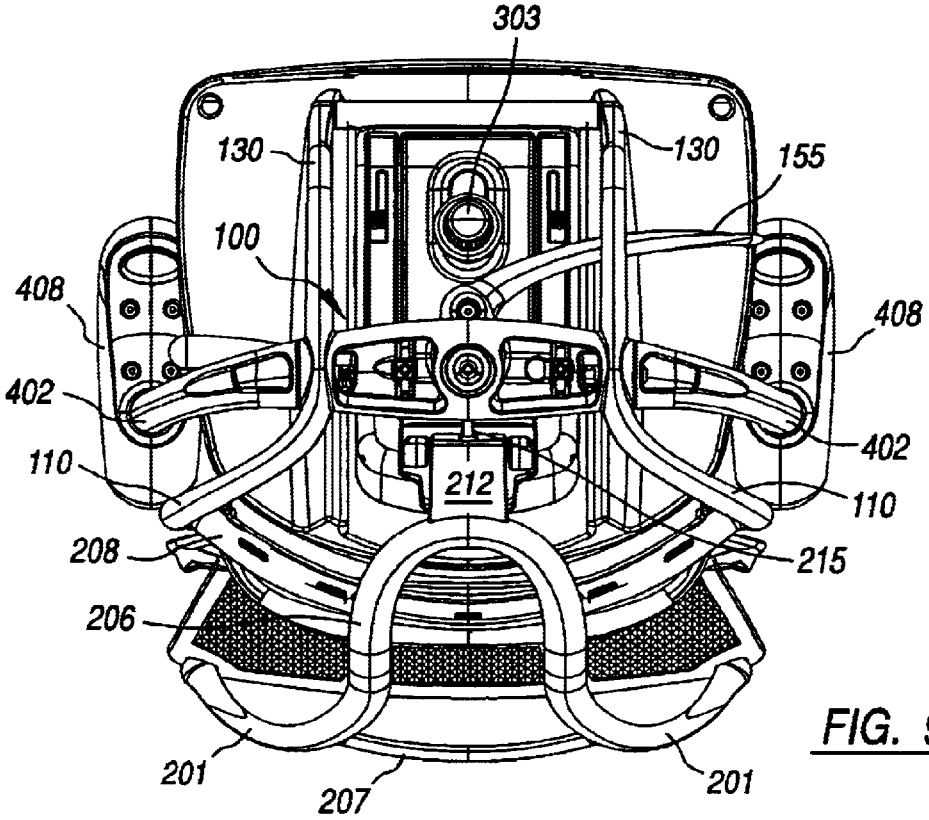
FIG. 9 is a bottom view with the ergonomic chair of FIG. 1 with a base removed.

As can be best seen in FIGS. 2, 6, 10 and 16*a*, a backrest module or assembly 200 which is a skeletal frame in arrangement, comprises a generally splayed outwardly U-shaped frame formed of a pair of spaced uprights 201 and having a lower connecting bight segment 206 (FIG. 9). An upper transverse member 207 and a lower transverse member 208 are both fixedly connected to uprights 201 to provide rigidity thereto. The lower member 208 is affixed to each upright 201 by an appropriate "C" shaped member 209 held in position by threaded fastener 202 fed into threaded bosses 203 one each upright 201. The members 209 serve to space the lower transverse member 208 forwardly of the uprights 201 for reasons which will be apparent. The lower transverse member 208 and the upper end assembly 205 of the uprights 201 receive and support a carrier 220 in which a mesh fabric 290 is positioned. The uprights 201 also are configured to support an adjustable lumbar member 250, all as described hereafter.

Figure 15:
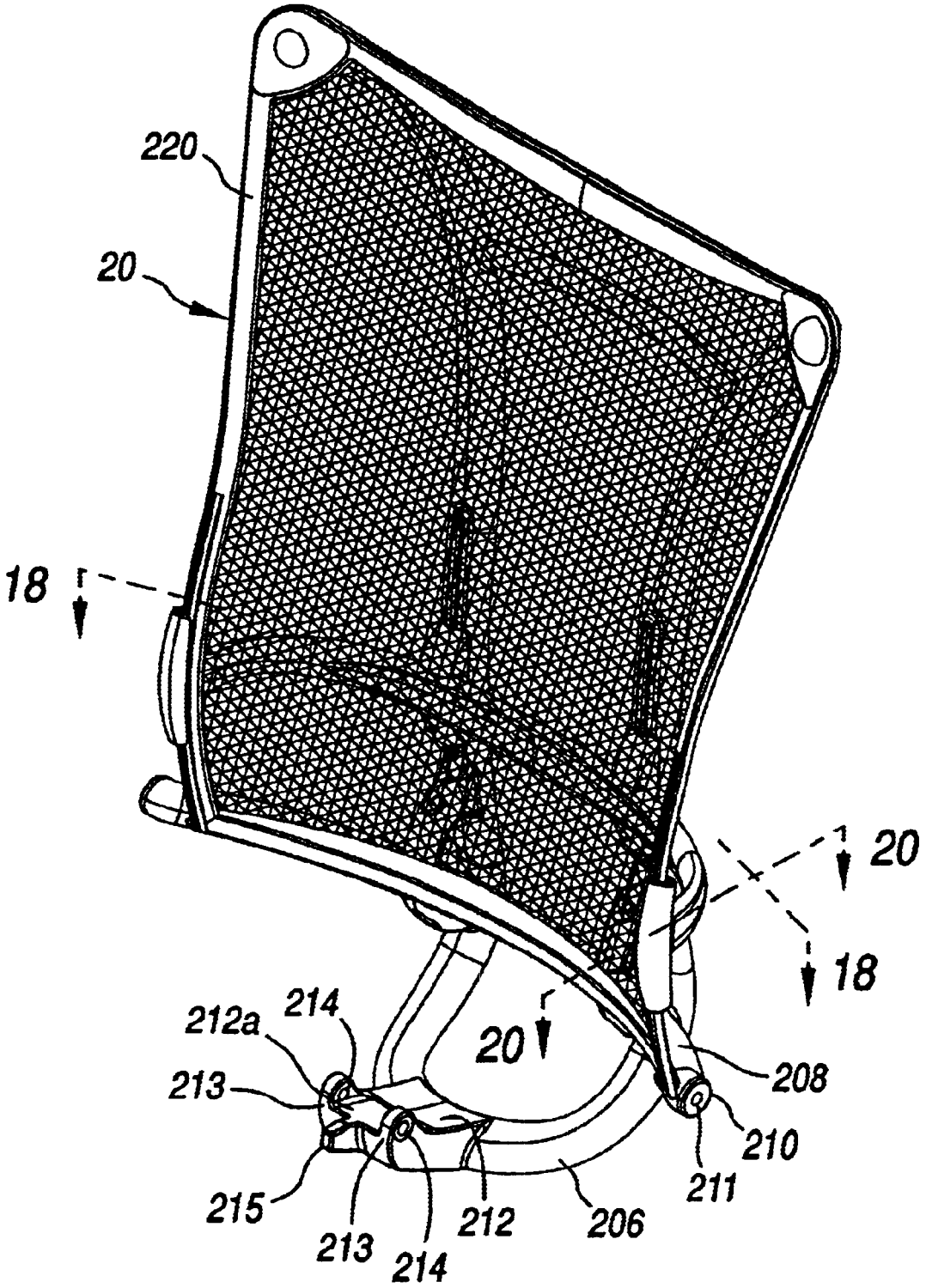
FIG. 15 is a perspective view of the preferred chair back assembly of the present invention.
Figure 16A:
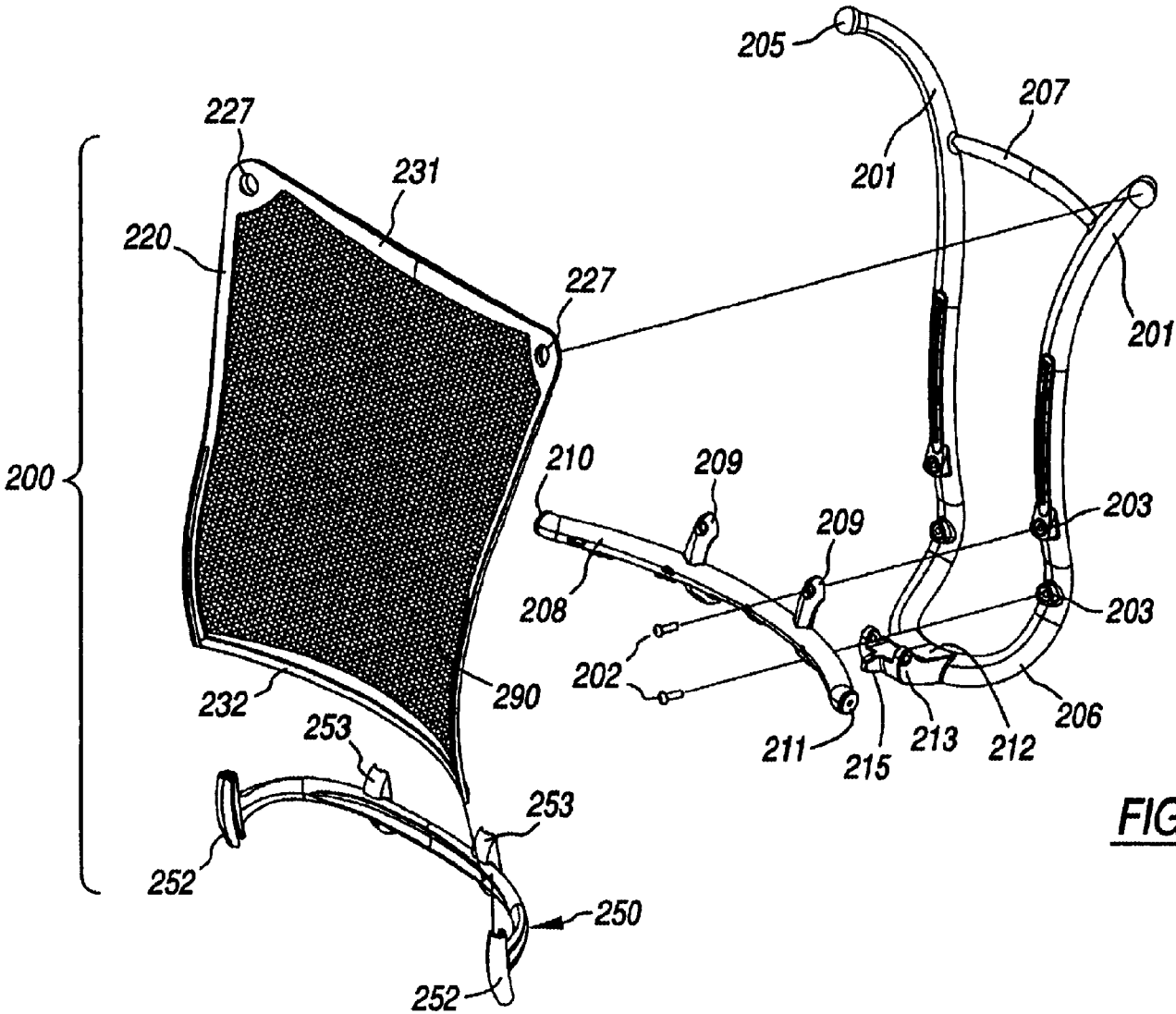
FIG. 16*a* is an exploded perspective view of the preferred chair back assembly of the present invention.
Figure 16B:
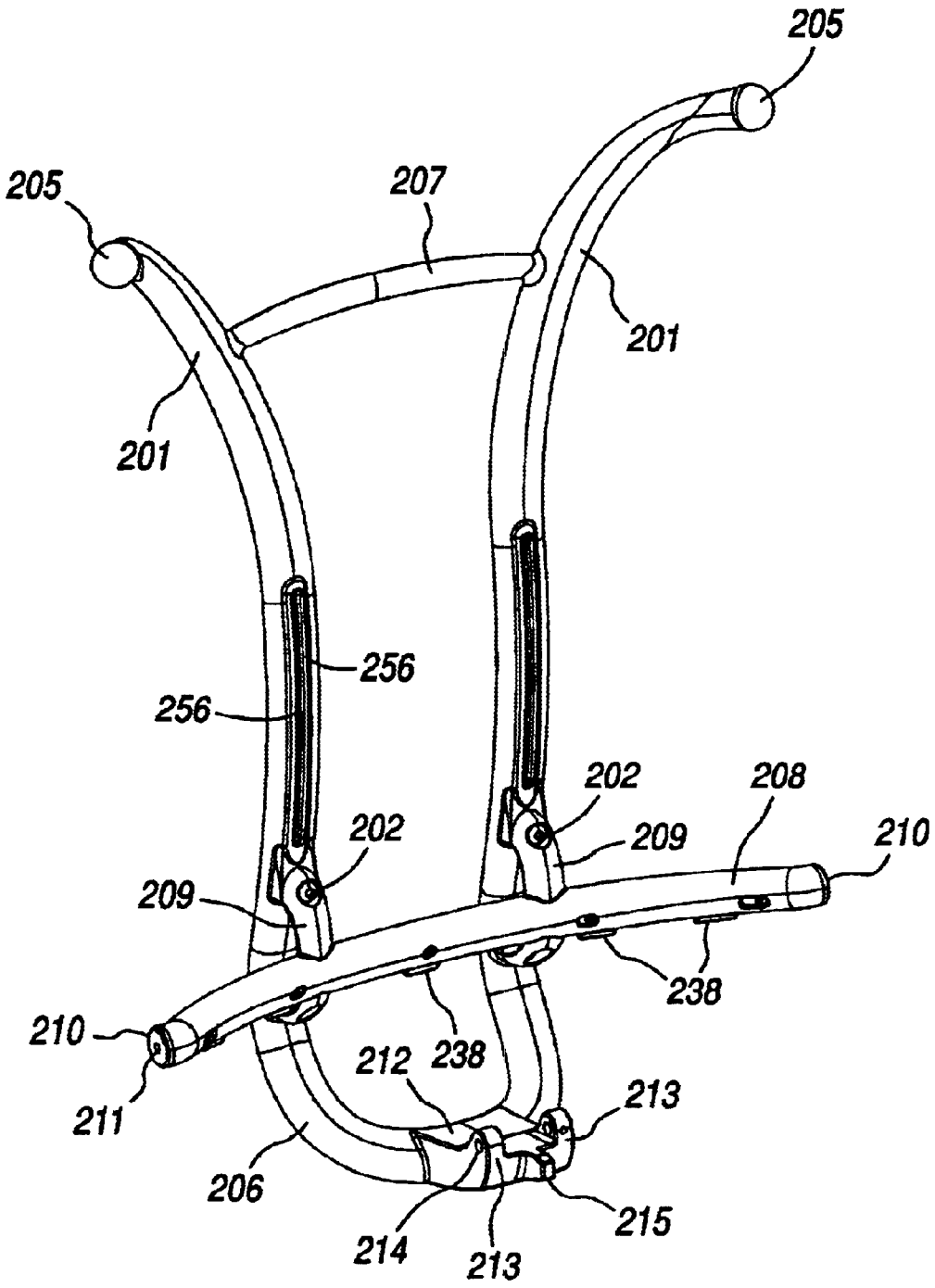
FIG. 16*b* is a perspective view of the assembled back frame without the backrest thereon.
Figure 17:
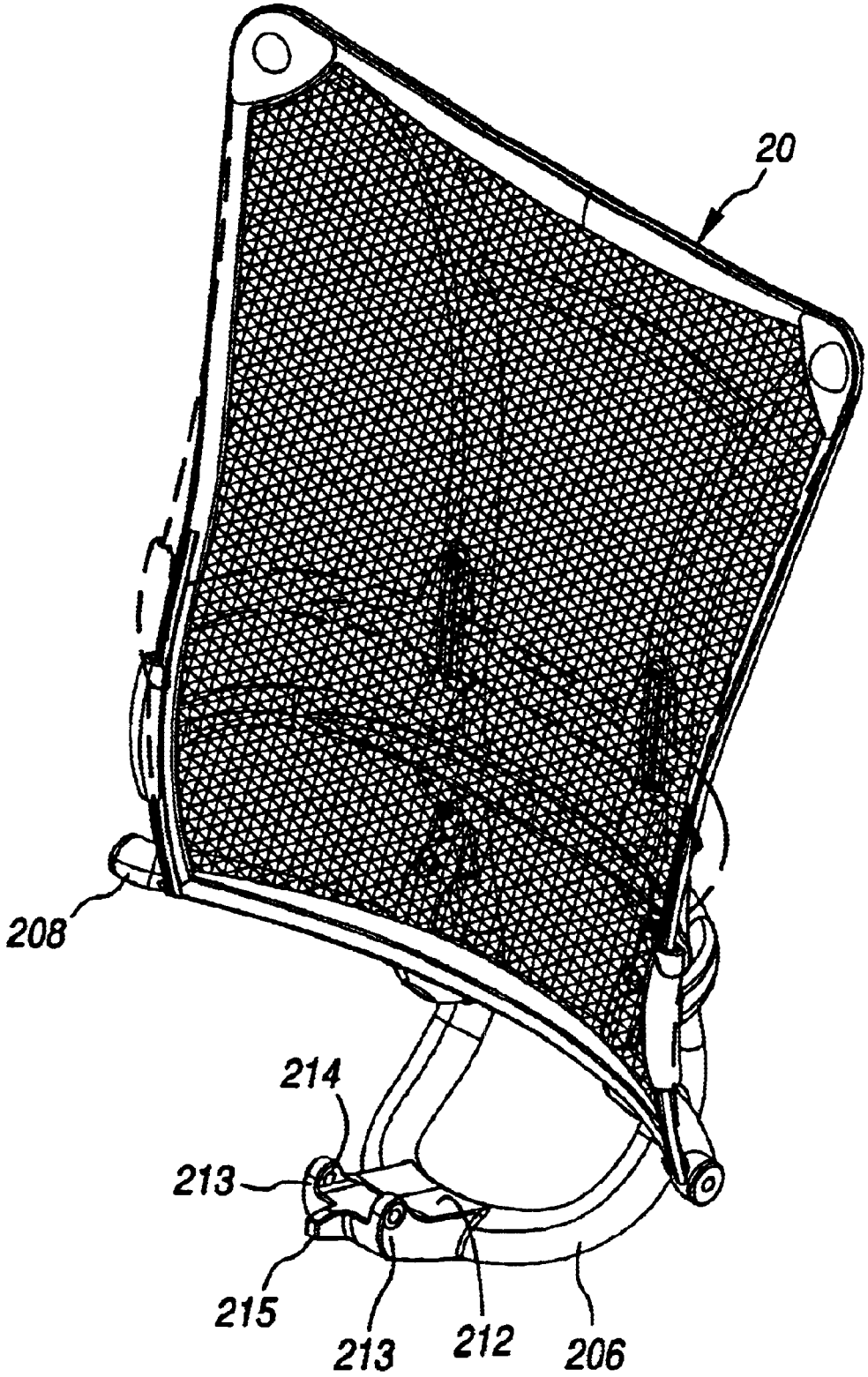
FIG. 17 is a perspective view of the chair back assembly illustrating the adjustability of the preferred form of adjustable lumbar support.
Figure 20:
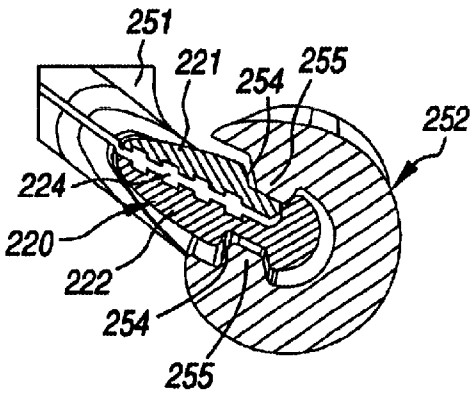
FIG. 20 is a partial cross sectional view showing the relationship of the lumbar member of the mesh carrier taken substantially along the line 20—20 in FIG. 15.

The right and left outer ends 210 on the lower transverse member 208 of the backrest assembly 200 provide pivotal attachment to the rear ends 120 of corresponding ones of the first and second elongated seat and back support modules 110 via the pivot pins and bearing sleeves (shown in FIG. 2) through apertures 121 in the support member 110 and openings 211, FIGS. 15, 16*a*, 16*b*, in the ends 210.

Centrally positioned lower bight portion 206 has at its forward end a clevis arrangement 212 FIG. 15, defined by a forwardly extending bracket 212*a* on which are formed a pair of spaced tabs 213 having openings 214 thereon for receiving a pivot pin. The forward end of the bracket 212*a* has a stop plate engagement member or projection 215 thereon that cooperates with the tilt limit mechanism as hereinafter described (see FIGS. 15 and 26).

With reference to FIGS. 29, 30, 31*a* and 31*b*, a seat member assembly or module 300 is illustrated in detail and includes generally a seat plate 330, a seat pan 301 and a fastener 303. Details of the seat assembly 300 are provided hereinafter and in copending U.S. Patent application entitled "Adjustable Chair Seat With Locking Mechanism," filed on even date herewith, Application No. 10/077,313, commonly assigned, the disclosure of which is incorporated herein in full by reference.

Briefly, the assembly 300 includes the seat plate 330 having a front end portion 331 having pivot pin apertures 332 and a pocket or housing style rear end portion 333. A pivot attachment means such as the pivot pins 132, 133, FIG. 2, pass through the apertures 131 in the seat support members 110 and into the apertures 332, FIG. 31*a* and are used to couple the front end portion 331 of the seat plate 330 to the front ends 130 of the seat and back support members 110.

Figure 29:
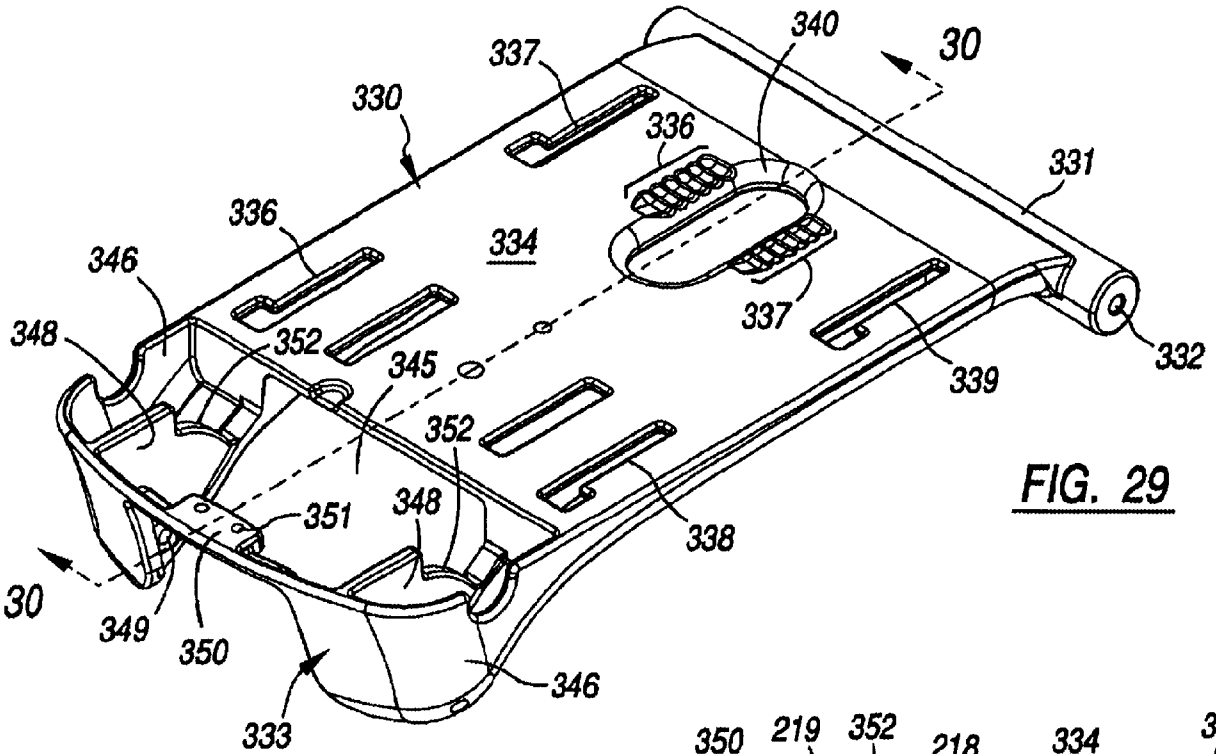
FIG. 29 is a top perspective view of a seat plate.
Figure 31A:
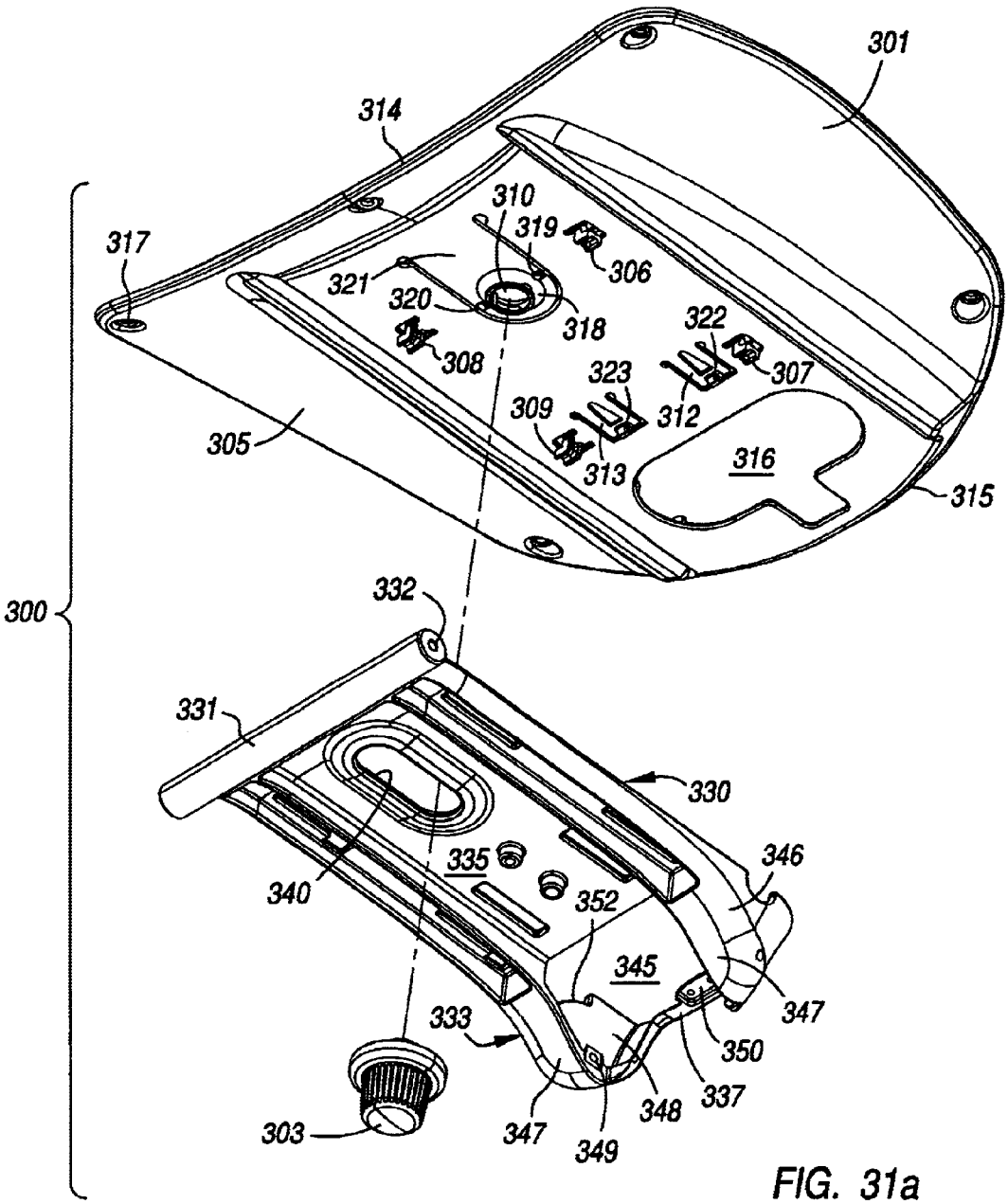
FIG. 31*a* is an exploded perspective view looking up into an assembled seat plate and seat pan.
Figure 31B:
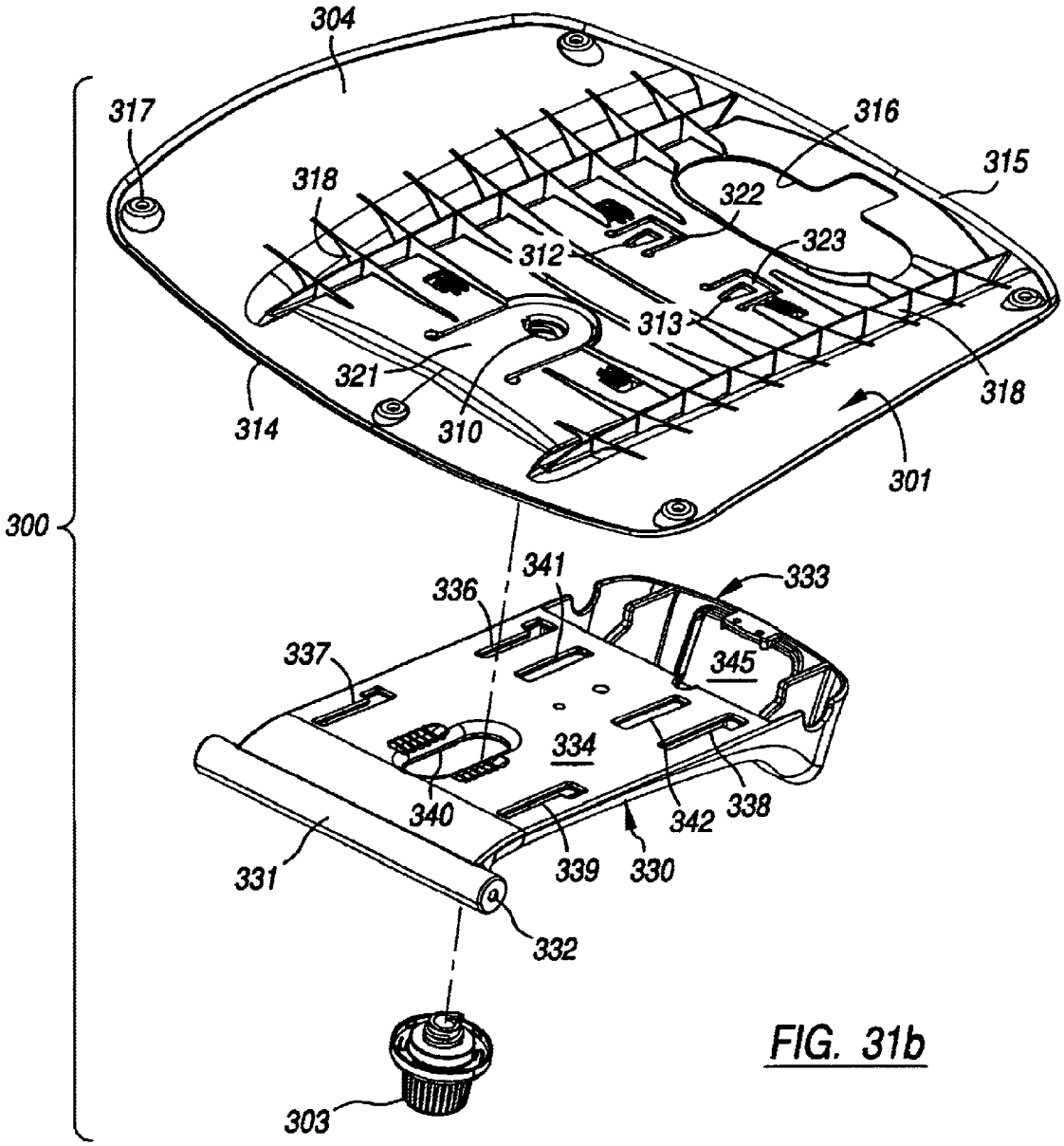
FIG. 31*b* is an exploded perspective view looking down on the assembly of the seat pan and seat plate.

A housing type structure is provided at the rear end portion 333 of the seat plate 330, and has depending outer walls 346. FIGS. 29, 31*a*, which include a lower bottom wall portion 347 extending partially across the width of the seat plate 330 to define the bottom of the housing. Spaced inwardly from the outer walls 346 are a pair of inner walls 348, provided with apertures 349 therethrough for purposes of receiving pivot pins 361, 362, FIG. 2, therethrough. A large opening 345 for receiving the clevis and projection members 215 and is disposed between the inner walls 348. At the top of the very rear of the seat plate 330 is a tab-like projection 350 having apertures 351 therethrough for reasons later explained. Positioned in a portion of the housing at the rear end portion 333 of the seat plate 330 are a pair of spaced pivot links 216, FIG. 2. A first lower end 217 of each of the links 216 is pivotably attached to the lower portion of the rear end portion 333 of the seat plate via pins 361, 362 at apertures 349. A second upper end 218 of each of the links 216 is attached to one tab 213 of the clevis 212 on the back rest frame module 200, as is described in more detail hereafter in relation to FIGS. 7*a*, 10 and 26*a*.

The rear end portion 333 of the housing section of seat plate 330 is constructed for pivotal coupling to the clevis arrangement 212. This pivotal coupling comprises the pair of laterally spaced link members 216, each having the lower end 217 for pivotal coupling to the respective sides of the seat plate 330 on the inner walls 348 and the upper ends 218 for pivotal coupling to the respective sides of the aperture/tabs 213 of the clevis 212.

Figure 7:
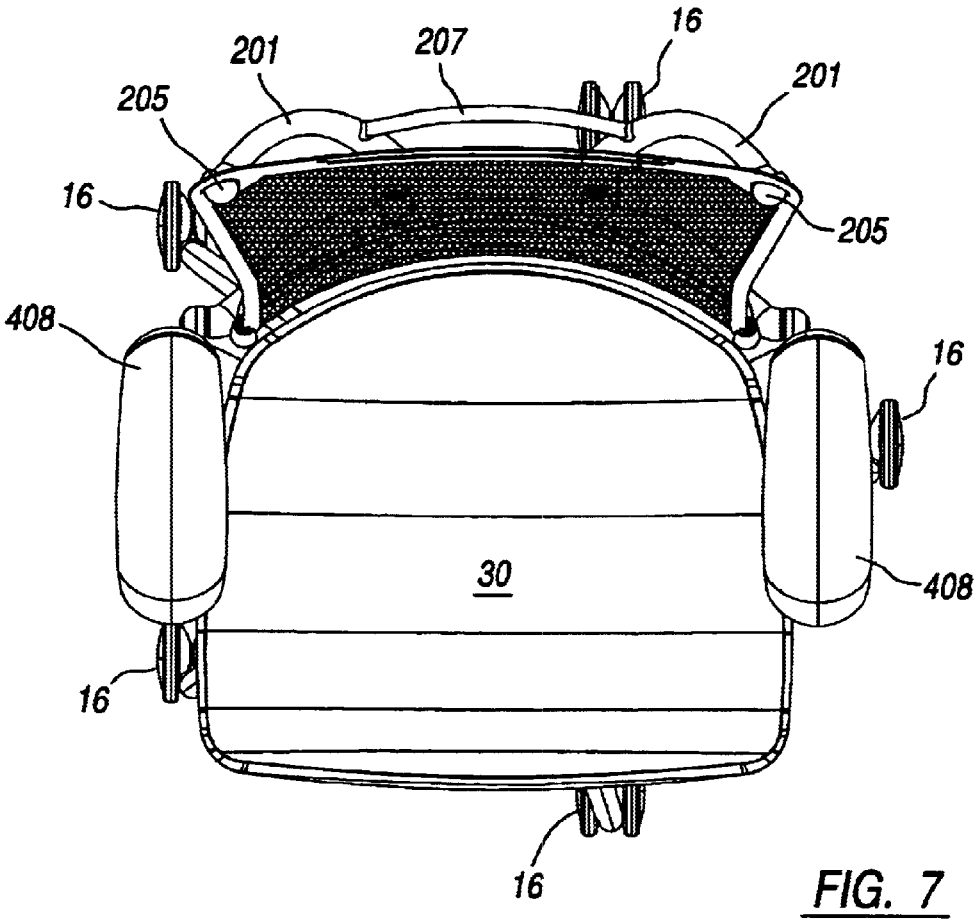
FIG. 7 is a top view of the ergonomic chair of FIG. 1.
Figure 7A:
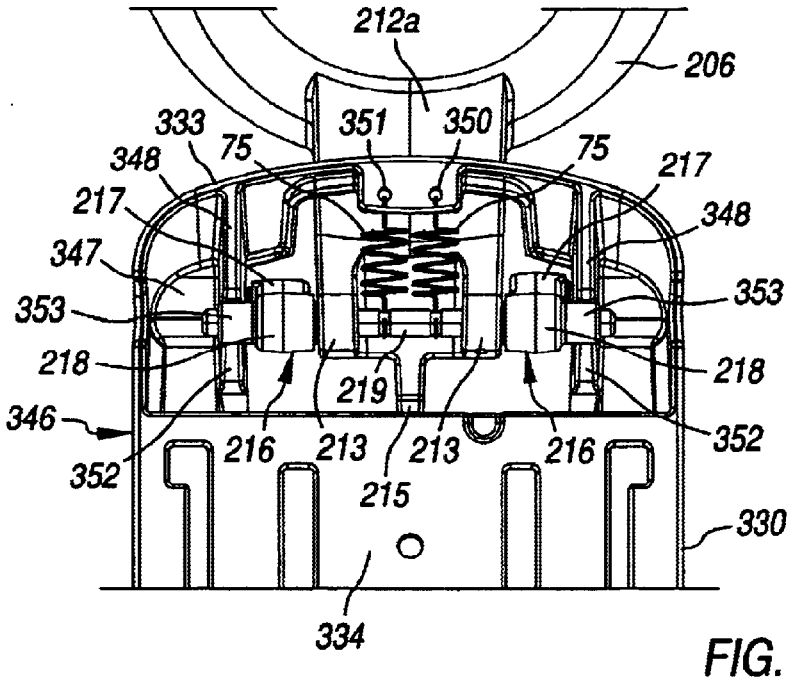
FIG. 7*a* is a partial top view of a seat of the ergonomic chair of FIG. 1 with a cushion assembly removed.
Figure 8:
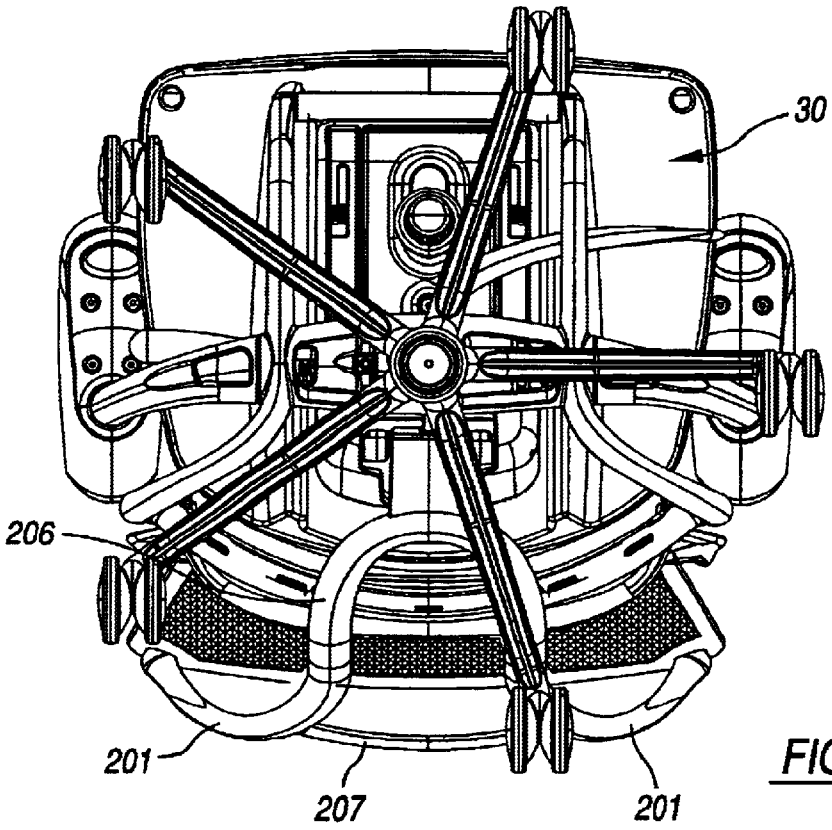
FIG. 8 is a bottom view of the ergonomic chair of FIG. 1.
Figure 30:
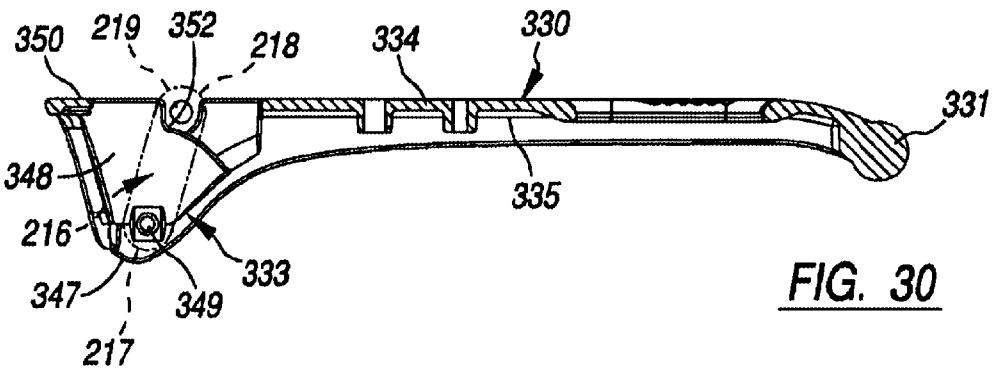
FIG. 30 is a cross-sectional view of the seat plate taken along the line 30—30 in FIG. 29.

A pivot pin 219, FIGS. 2, 7*a*, extends through the openings 214, FIG. 15, in the tab members 213 of the clevis, and passes through openings in the upper ends 218 of each of the link members 216. The pin 219 extends over spaced apart curved surface ledges 352 at the top of the inner walls 348 for defining movement of the link members 216. As seen in FIG. 30, the curved ledges 352 of each inner wall supports roller ends 353, FIG. 7A, of the pin 219 and the upper ends 218 of the link members 216, and provides the guide path and limit stops for movement of the upper ends of the link members and thus of the link members 216. The lower end 217 of each link member 216 is pivotally connected to the bottom portion of inner walls 348 via pins 361, 362 that are passed through the apertures 349 disposed near the bottom wall 347 of each inner wall 348. The upper ends 218 of the links 216, when the chair is unweighted by a user (or if weighted but not reclined), will be at the upper ends of the ledges 352 as shown in FIG. 30. As the back 20 reclines or tilts, the pin 219 will move along the curved descending ledges 352 toward the bottom thereof. Because the link also is pinned to the seat 330 at the aperture 349, it will cause the rear portion 333 of the seat plate 330 to rotate and rise about the front end portion 331.

The relative positions of the seat 30 and back 20 of the chair 10, during reclining of the back 20, can be seen in the side views of FIGS. 10–12. The chair seat plate 330 is pivotably connected via the pins 132, 133 at pivot points $P_{30}$ to the forward end 130 of support members 110 (only one of which can be seen) and is pivotably connected at rear pivot points $P_{32}$ to the lower ends 217 of the links 216 at the apertures 349 by the pins 361, 362. Each link 216 in turn is pivotably connected at its upper end 218 at pivot point $P_{34}$ to the clevis 212 on the back frame assembly 200. The back frame assembly 200 also is pivotably connected via the lower transverse member 208 at pivot point $P_{20}$ to the two laterally spaced support ends 120 of the frame support members 110.

Figure 10A:
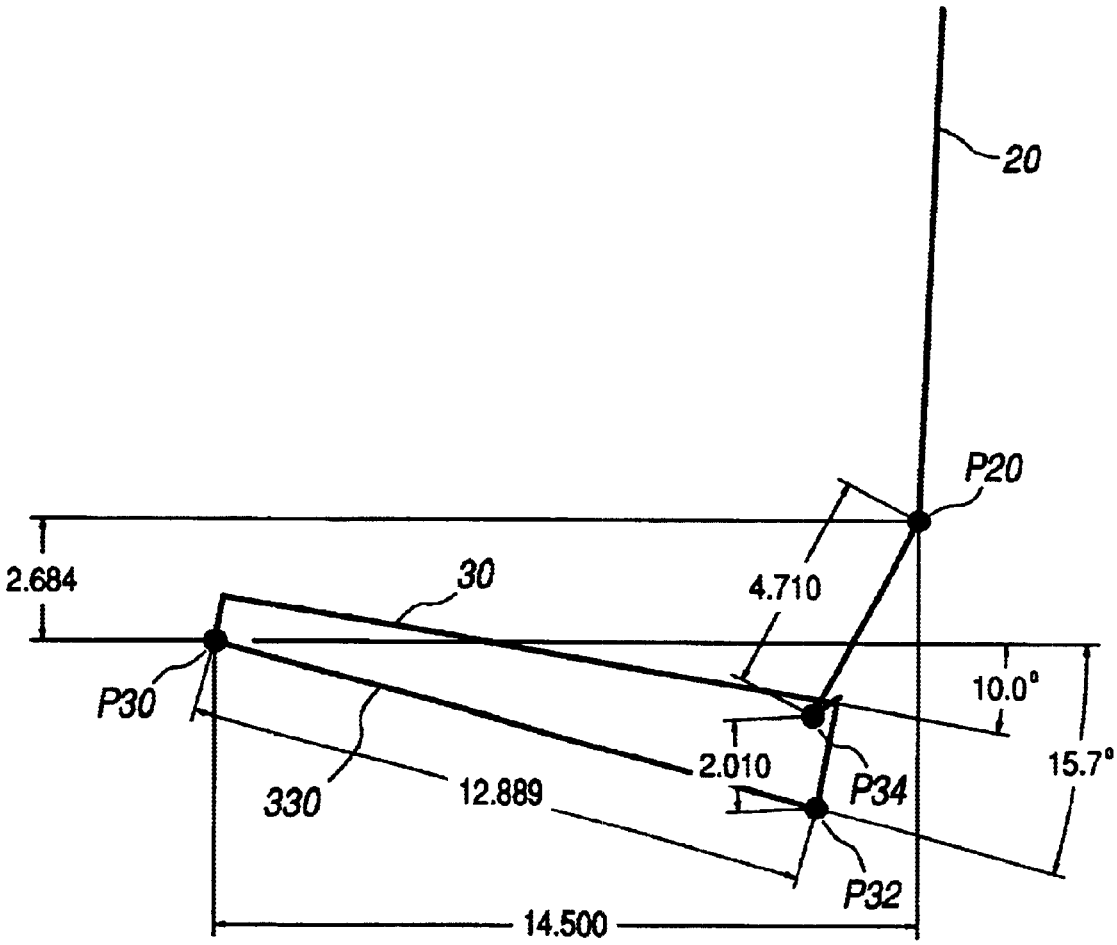
FIG. 10*a* is a side schematic view showing the preferred dimensional relationships between components of the ergonomic chair of FIG. 1 with the chair back in a fully upright position.

As shown in the dimensional schematic of FIG. 10*a*, when the chair back 20 is in a fully upright position the seat 30 in one preferred form is inclined to the rear and forms an angle of about 10.0 degrees from horizontal, and the angle of the seat plate 330 forms an angle of about 15.7 degrees from the horizontal although the this angle of the seat elate can be in a range of between about 10 and 20 degrees. The preferred distance between the pivot points $P_{30}$ and $P_{32}$ is about 12.889 inches and the distance between the pivot points $P_{32}$ and $P_{34}$ of the links 216 is approximately 2.01 inches, although these distances can be in ranges of between about 10 and 15 inches and about 1.5 to 2.5 inches, respectively. Further, the preferred distance between the pivot points $P_{20}$ and $P_{34}$ is approximately 4.71 inches while the horizontal distance between pivot points $P_{30}$ and $P_{20}$ is about 14.5 inches. The distance between the pivot points $P_{20}$ and $P_{34}$ may be in the range of between about 3 and 6 inches while the distance between the pivot points $P_{30}$ and $P_{20}$ may be in a range of between about 12 and 17 inches.

Figure 12A:
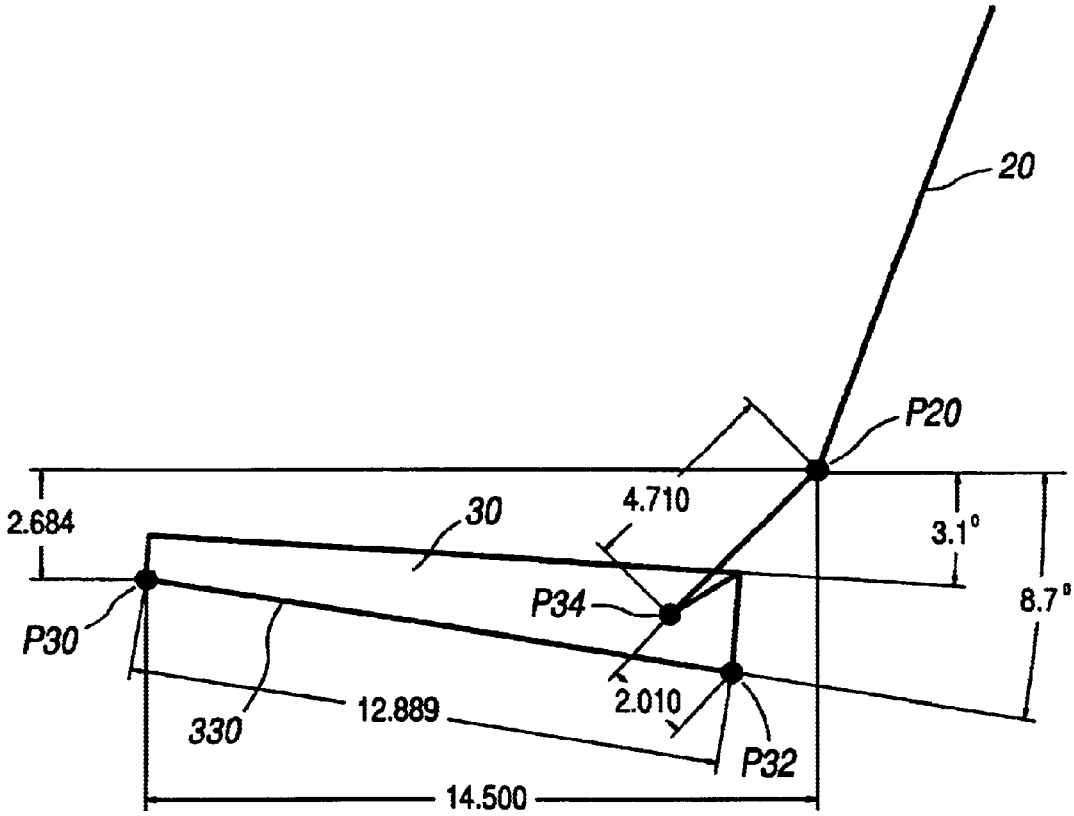
FIG. 12*a* is a side schematic view showing the preferred dimensional relationships between the ergonomic chair components when the chair back is in a fully reclined position.

As shown in the three stages of back tilt illustrated in FIGS. 10–12, as the back 20 reclines rearwardly, the links 216 move in a counterclockwise direction of rotation about pivot $P_{32}$ causing the rear end portion 333, FIGS. 2, 29, 30 of the seat plate 330 to pivot about the pins 132, 133 at the front end portion 331 and elevate the rear end portion relative to the front end portion 331. In the fully reclined position of the back 20 as shown in the schematic of FIG. 12*a* the seat plate 330 preferably reduces its angle of inclination with the horizontal from about 15.7 degrees (FIG. 10*a*) to about 8.7 degrees and the seat 30 reduces its angle of inclination from about 10 degrees to about 3.1 degrees, while the afore-described distances between all pivot points remain constant. The reduced inclination angle of the seat plate 330 may be in a range of between about 6 and 10 degrees. This synchronous motion of the seat plate 330 and the seat 30 with the back 20 provides for an exceptionally comfortable reclining motion of the chair user to aid in avoiding fatigue as the user is performing various work-related tasks. The ride motion is achieved by a simple seatback-seatrest four bar mechanism, which immediately responds to a user exerting a back force and/or self-weight. A back force applied by the user against the back 20 induces a lift in the rear part of the seat, during reclining, in a synchronic-type motion and vise versa.

The chair link mechanism restores ride stability, and attains a desirable ride quality, equally well for a wide range of users, by varying the back force reaction in the mechanism. The back force reaction results from users imposing their own back force and/or self-weight on the chair mechanism. By proportioning linkages lengths, and selecting the locations of the rotationally-free hinges, i.e., the pivots, the back force reaction is designed to vary in order to achieve balance. This continuous force balancing process, which characterizes the ride motion at all positions, establishes and maintains an equilibrated ride. As a result, the need for a user to consciously adjust a back tilt tension knob, to feel comfortably balanced when reclining, is replaced with this more adaptive and dynamic feature. By doing so, the chair design is taken one step further toward conformance to all users without involving them in unnecessary conscious feature-adjustment efforts.

Figure 13:
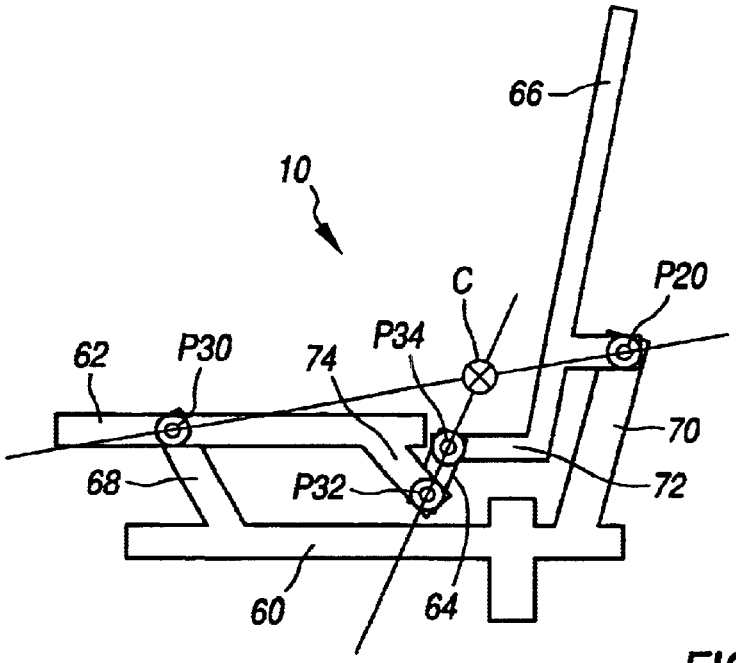
FIG. 13 is a side schematic view showing the linkage arrangement of the chair.

The mechanism configuration determines the location of the instantaneous center of chair rotation. As the configuration changes as a result of changing the sitting posture and position, the chair design allows the locus of its instantaneous center of rotation to generally coincide with the user's rotation center, i.e, hip joint, at all locations within the ride range (FIG. 13). This feature is calibrated for equal performance to many users, where the instantaneous center of chair rotation is set to move along the locus, i.e. trajectory. By maintaining this quality in the ride, abdominal, back, and other muscuoleskeletal straining, are all eliminated in the full ride range. A more uniform foot reaction is maintained in the ride, therefore, enhancing the ride quality even further. Also, the opening of the torso-legs angle enhances fluid circulation and other ergonomic factors.

Figure 14:
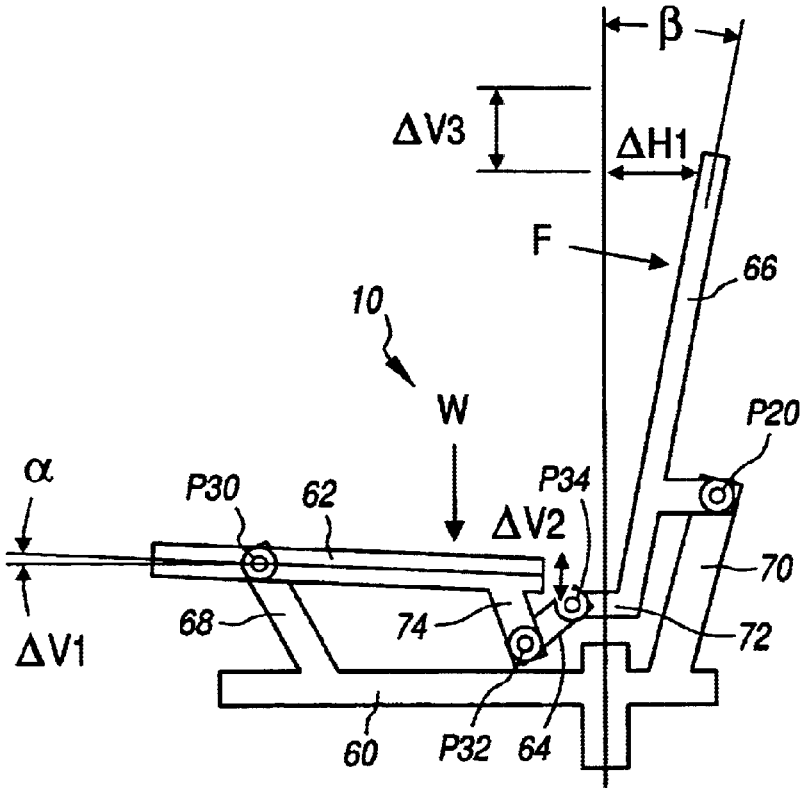
FIG. 14 is a side schematic view showing the kinematics of the chair.

Shown in FIGS. 13 and 14 are schematic views of the synchronous seat and back tilt feature employing the four-bar mechanism which allows the rear of the seat 30 to elevate as the backrest 20 is reclined. The mechanism is designed to immediately respond to the users weight and provide the correct back support throughout the range of back reclining. This function allows for reclining of the chair 10 about an instantaneous center point C that, as noted, is very closely coincident with the pivot axis of the user's hips and avoids undesirable "shirt pull" of the user. Also, because the front of the seat 30 is not elevated during back reclining, no additional pressure is applied to the front underside of the user's thighs, and also a relatively constant gaze angle is maintained during reclining.

To accomplish the foregoing advantages, the chair 10 schematically comprises four basic members and four rotationally-free pivots. The basic members include a floor supported member 60, a seat rest 62, a linking member 64 and a backrest 66. The floor supported member 60 has an upwardly directed portion 68 that terminates at an end defining pivot point $P_{30}$ to which the seat rest 62 is pivotably connected at its forward portion. The member 60 also has an upwardly directed portion 70 which terminates at an end defining pivot point $P_{20}$ to which the backrest 66 is pivotably connected. A lower portion 72 of the back rest 66 is pivotably connected at point $P_{34}$ to the upper end of linking member 64 and a downwardly extending portion 74 of the seat rest 62 is pivotably connected at point $P_{32}$ to the other lower end of the linking member 64.

The kinematics of the chair 10 are illustrated in FIG. 14. As force F is applied on the backrest 66, the back tilt angle $\beta$ increases, eye location shifts backwards an amount $\Delta H1$, and eye elevation decreases by an amount $\Delta V3$. The change in back tilt angle $\beta$ transmits motion by way of the upper and lower back pivots $P_{20}$ and $P_{34}$, respectively, to the linking member 64. As a result of the position of the linking member 64, the rear seat pivot $P_{32}$ moves in coordination with pivot $P_{34}$ in a composite rotational and translation motion. As the seat rest 62 rotates about pivot $P_{30}$, a lift $\Delta V2$ is caused in the rear part of the seat rest 62 relative to its front edge $\Delta V1$ in the amount $\Delta V2$-$\Delta V1$, therefore introducing a seat rest angle $\alpha$. During back reclining an increasing portion of the user's weight supported by the chair is transferred from the seat support to the back support while the mechanical advantage of the mechanism lifting the seat support decreases. The user will therefore sense a static balance position in any position of recline and will require little effort to move to a new position.

As the user sits in the chair, a back force, F, and/or weight, W, is exerted on the chair mechanism and, therefore, sets it in a self-equilibrating motion, with ride qualities that are designed beforehand. These forces may only be balanced by a proper back force reaction, and by the chair reconfiguring its geometry to the level required by the exerted force. By doing so, the motion response parameters appearing in FIGS. 13, 14, are varied in known proportions and rates to achieve the ride quality. The design ride range subtends a backrest angle from about 90° to about 120°.

To fine-tune the ride qualify, and to provide for static overall stifthess, the mechanism may also be equipped with external elements, including springs. The addition of these external devices would further calibrate the ride quality towards its desirable, pre-designed features, while, at the same time, maintaining all other functional qualities intact. Thus, in order to assist the chair linkage mechanism in allowing the backrest member 20 to maintain a fully upright position when the chair 10 is not in use, as shown in FIG. 10 one or more extension springs 75, FIG. 7*a*, may be connected between pivot shaft 219 and the rear edge portion 350 of the seat plate 330. The pivot shaft 219 essentially also defines pivot point $P_{34}$ and will cause a return force to be exerted on back frame assembly 200 by the springs 75.

In order to relate the explanation of the schematic linkage as described in FIGS. 10*a*, 12*a*, 13 and 14, to the chair 10, the respective parts on the chair correspond to the parts as numbered on the schematic linkage

| CHAIR | LINKAGE SCHEMATIC | |
|---|---|---|
| 110 | 60 | Floor support member |
| 30 | 62 | Seat |
| 216 | 64 | Link member |
| 20 | 66 | Backrest |
| 130 | 68 | Front upward member on 60 |
| 120 | 70 | Rear upward member on 60 |
| 212 | 72 | Lower portion of backrest 66 |
| 348, 349 | 74 | Downward portion of seat rest 62 |

Figure 26:
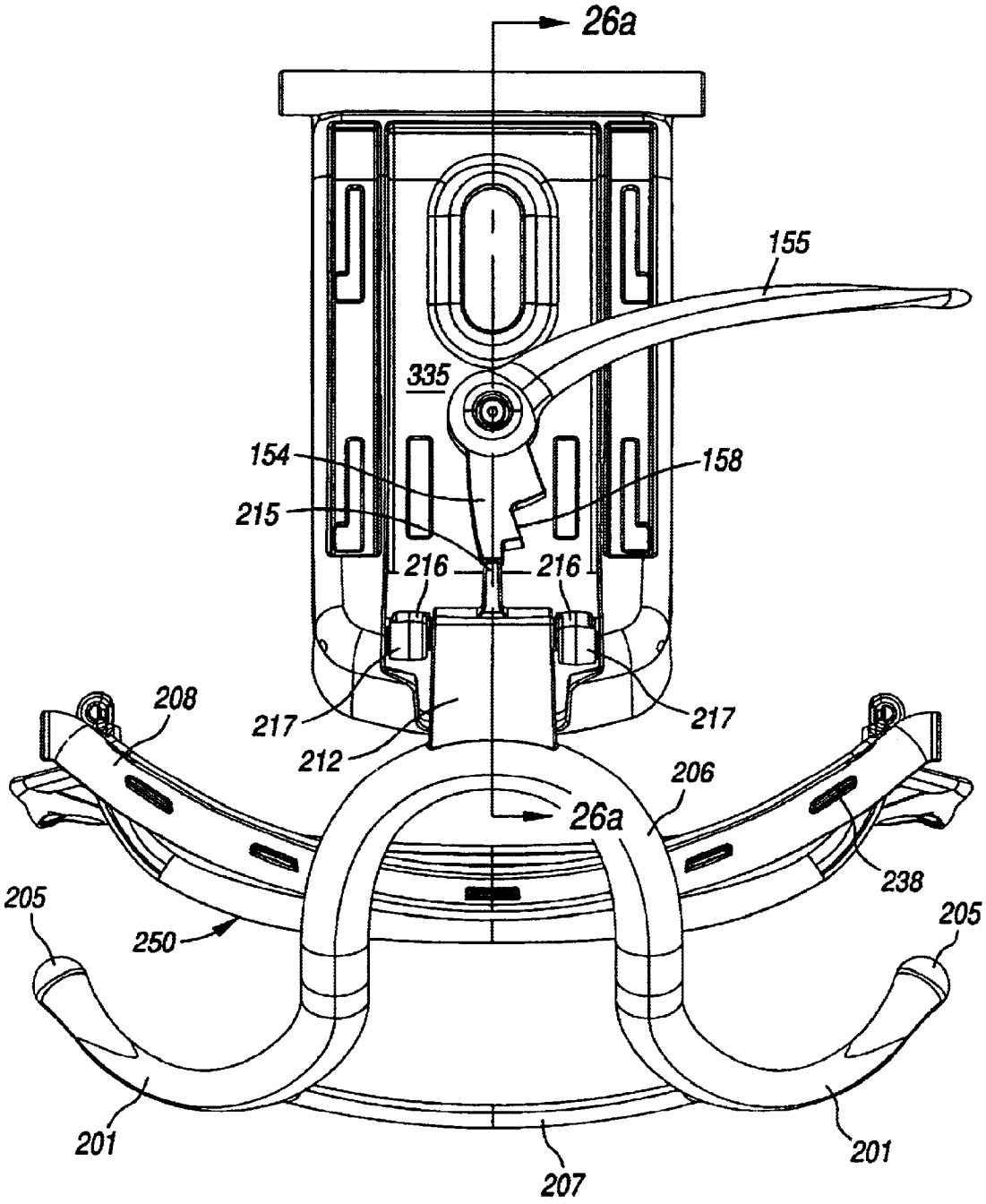
FIG. 26 is an enlarged partial bottom view showing detail of a tilt limit mechanism, with the base, arms and seat of the chair removed for ease of understanding.
Figure 26A:
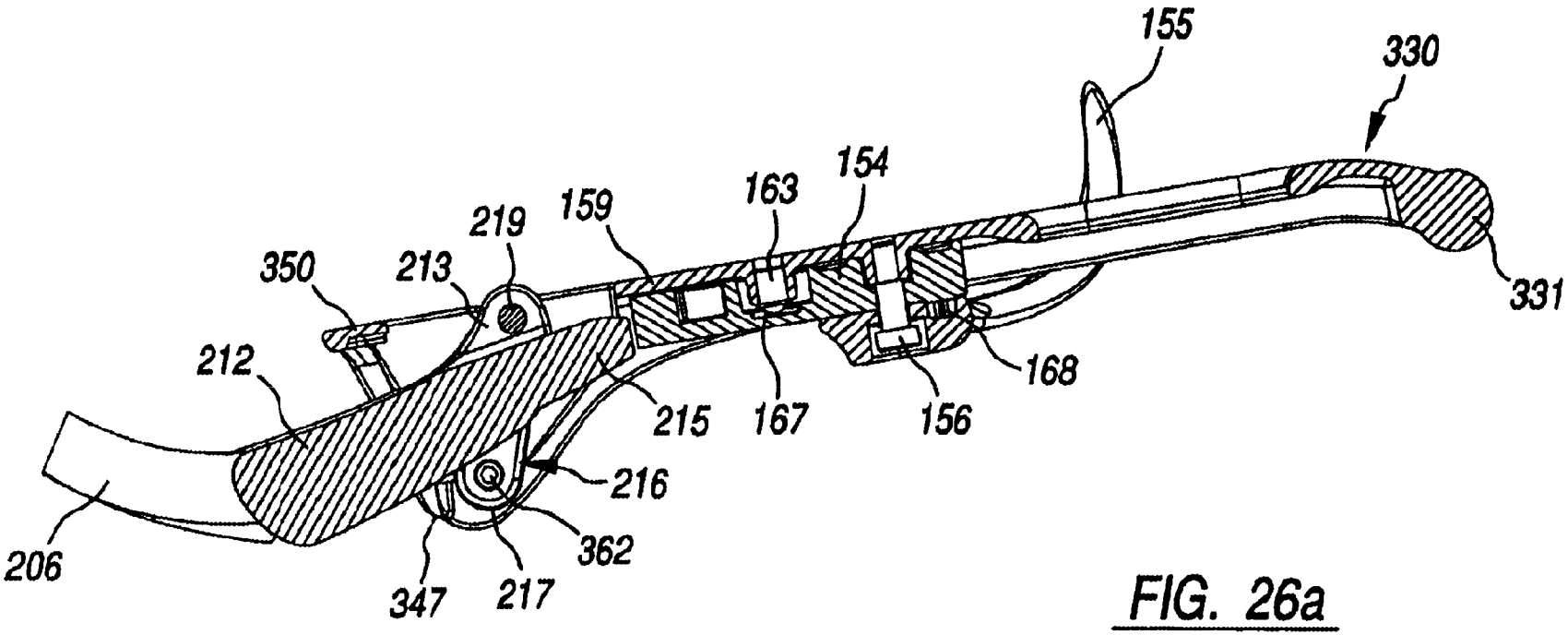
FIG. 26*a* is a cross-sectional view taken along the line 26*a*—26*a* in FIG. 26, showing details of the link and tilt limit mechanism with greater clarity.
Figure 28:
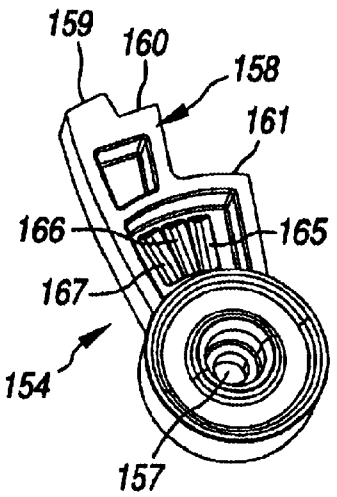
FIG. 28 is an enlarged perspective view of a stop plate of the tilt limit mechanism.
Figure 27:
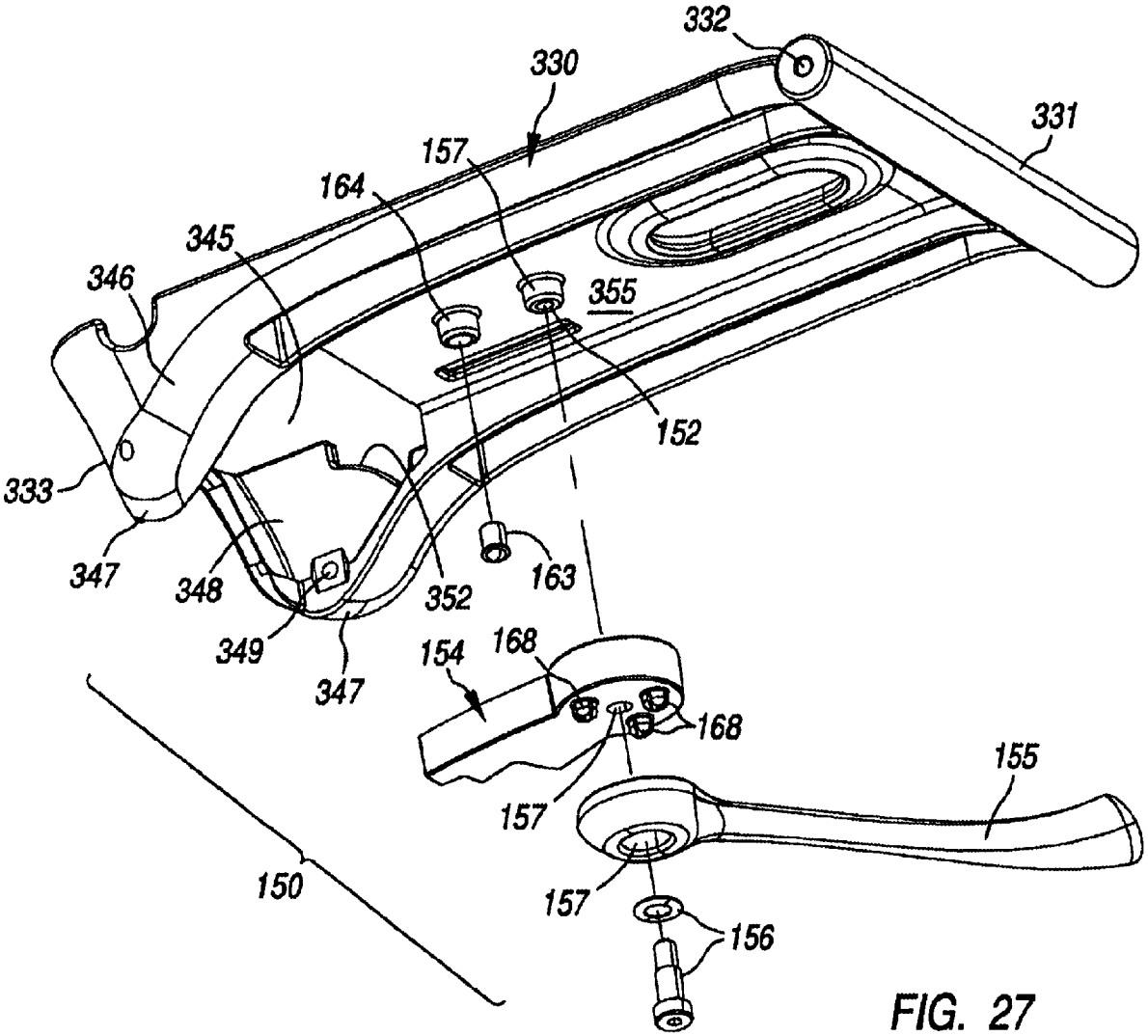
FIG. 27 is a bottom exploded perspective view showing further detail of the tilt limit mechanism.

FIGS. 26–28, a very simple and economical seat back tilt limit control module 150 is associated with the seat assembly 300 using a lever handle 155 attached to the tilt limit module for adjusting the amount of permissible tilt of the seat back 20. As can be seen in FIG. 27, the seat plate 330 has a threaded stub 152 on the bottom side 335 thereof to which a stop plate 154 and the lever handle 155 can be attached by a shoulder bolt and washer 156 that is threadedly inserted into stub through aligned orifices 157 in the handle, stop plate and stub. The lever handle 155 may be attached to the stop plate 154 from either side of the chair 10, and herein is shown on the left side. It will be noted that stop plate 154 has an outer edge 158 with a series of steps of different radii for interacting with the engaging member 215 carried by the end of the clevis 212 at the bottom of the back rest frame 200, as will be seen more clearly in FIG. 16. In the preferred embodiment, the engagement member 215 is in the form of a nose-like protrusion.

The outer edge 158 of stop plate 154 has specific steps 159, 160, and 161, as can be best seen in FIG. 28, and each is at a different distance from the central axis defined by aperture 157 with respect to the other. A locking means 163, in the form of a spring-biased plunger is mounted in a boss 164 on the bottom of seat plate 330 and engages detents 165, 166 and 167 found in the upper portion of stop plate 154. It will be noted that the outer edge 158 of stop plate 154 could be a smooth cam having an edge of a continuously changing radius. The number of detents determines the number of fixed chair back tilt positions.

The indexing detents 165, 166 and 167 are of concave shape and are adjacent each other. Since the spring-loaded plunger is in the form of a spring-loaded ball 163, the plunger is enabled to freely move from one concave detent to another by compressing the spring and rotating the lever 156 and thus the stop plate 154 to permit the plunger to be positioned in any selected detent and by releasing the plunger to cause the stop plate to hold the back frame in a selected tilt position.

Because the projection 215 is below the pivot axis $P_{20}$ formed at ends 120 and 210, as the back frame 200 pivots about axis $P_{20}$, the protrusion 215 moves inwardly towards the seat stop plate 154 thus allowing adjustment of the tilt mechanism by moving handle or lever 155. The handle 155 is fixed from rotation relative to stop plate 154 via a number of matching spring fingers 168, engaging recesses in the handle. When the lever 155 and the stop plate 154 rotates, it causes the various steps 159, 160 and 161 on the outer edge thereof to be in selective engagement with the projection 215. The details of the tilt limit module are disclosed and claimed in commonly assigned co-pending patent application Ser. No. 09/882,500 filed Jun. 15, 2001, and entitled "Multi-Position Tilt-Limiting Mechanism," the disclosure of which is incorporated herein in full by reference.

Turning now to FIGS. 15, 16*a*, 16*b* and 17, the complete backrest assembly 200 of the chair 10 is illustrated in perspective and shows the novel feature of the lumbar support construction and carrier assembly which will be described in detail.

Figure 21A:
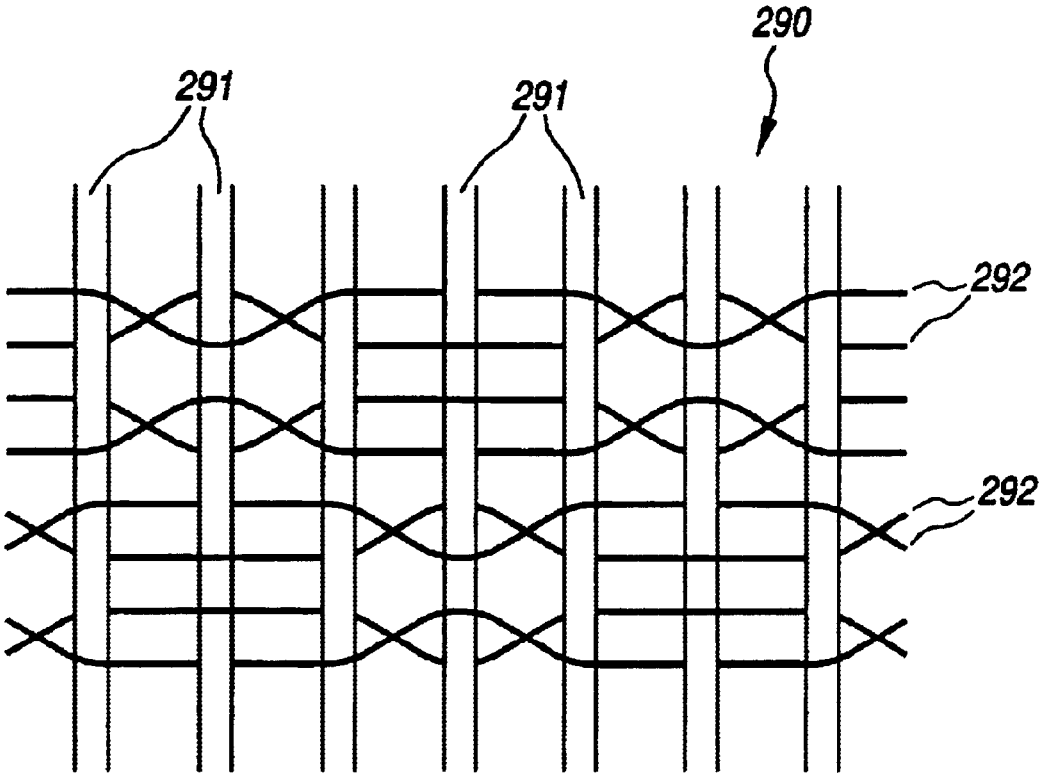
FIG. 21*a* is an enlarged view of one form of mesh arrangement for use in the invention.

Yet another novel and highly functional feature of the chair 10 that offers ergonomic advantages over the prior art is the construction of the chair back 20. As previously noted, the back 20 is designed to include a panel of fabric mesh 290 which is preferably of an open weave type known in the art. The construction of the fabric mesh 290 may have a variety of weave configurations. One configuration that has proved to be advantageous is shown in FIG. 21*a* comprising vertical strands 291 of multifilament yarn and horizontal monofilaments 292. The monofilaments 292 in this construction can be seen to cross over the strands 291 and also crisscross over each other thereby locking the strands 291 in place.

Figure 21B:
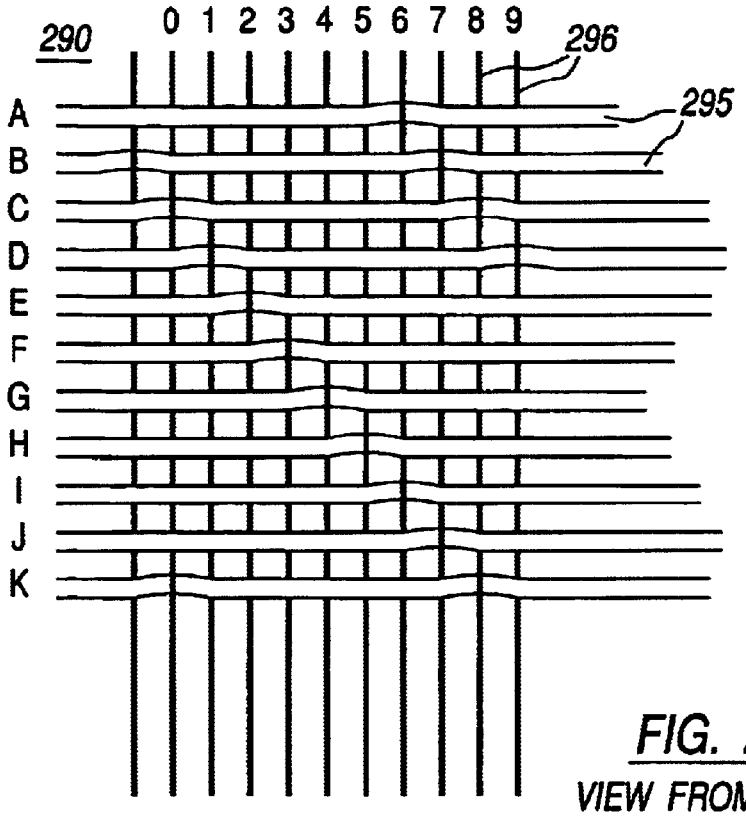
FIG. 21*b* is an enlarged front view of a second preferred embodiment of mesh arrangement for use with the present invention.
Figure 21C:
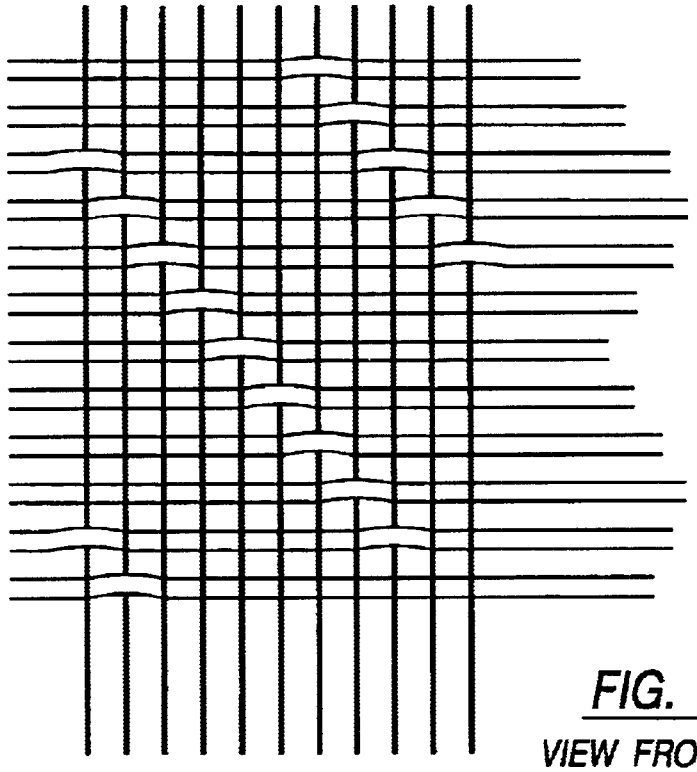
FIG. 21*c* is an enlarged rear view of the mesh of FIG. 21*b;*
Figure 22:
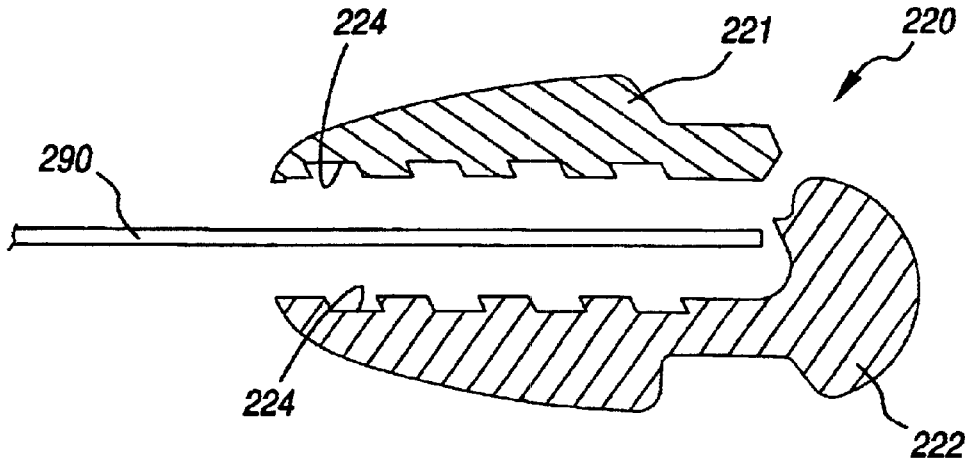
FIG. 22 is an enlarged exploded sectional view showing one form of assembly of the mesh to a carrier.
Figure 23:
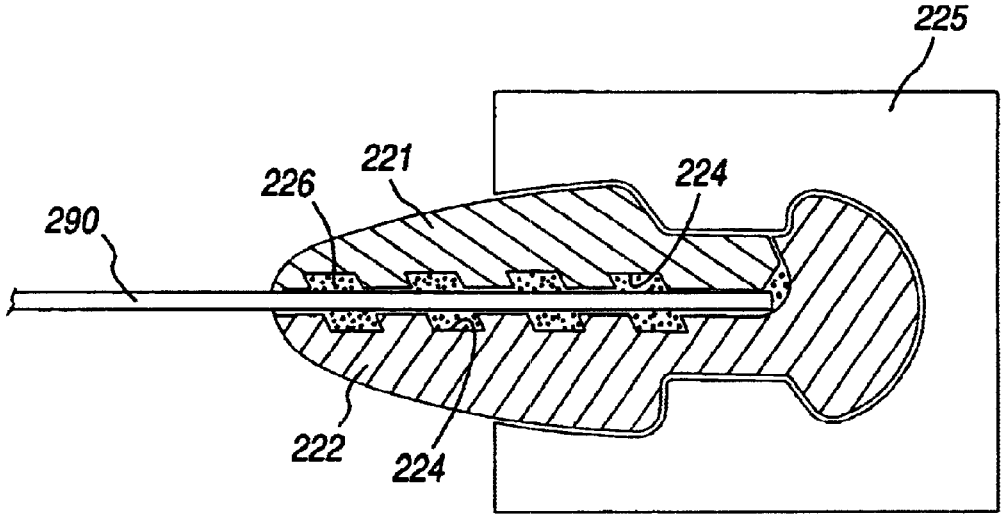
FIG. 23 is a view similar to FIG. 22 showing an adhesive bonding method of fastening the mesh to a carrier.

A preferred mesh weave is shown in front and back views in FIGS. 21*b* and 21*c*, respectively. In this version, the horizontal multifilament or weft material 295 is simply interwoven in steps with a vertical monofilament warp 296. In the illustrated embodiment the warp does not cross the weft at each adjacent position. In this pattern for each warp cross over a weft, there will be seven warps between that do not cross the same weft before a repeat. Thus warps "0" and "8" cross weft C, while warps 1 and 9 cross weft D. The warp material preferably is made of Hytrel® monofilament of 730 Denier. This provides structure and a relatively "shiny" look to the back of the chair. The weft 295 is a multifilament which includes a polymer yarn and an amount of Hytrel®. The multifilament is a suitable synthetic resin and provides a relatively soft and comfortable feel to the front surface of the chair back. Because of the pattern, it also has a more finished and pleasing esthetic look as compared to open mesh of different patterns.

Figure 24:
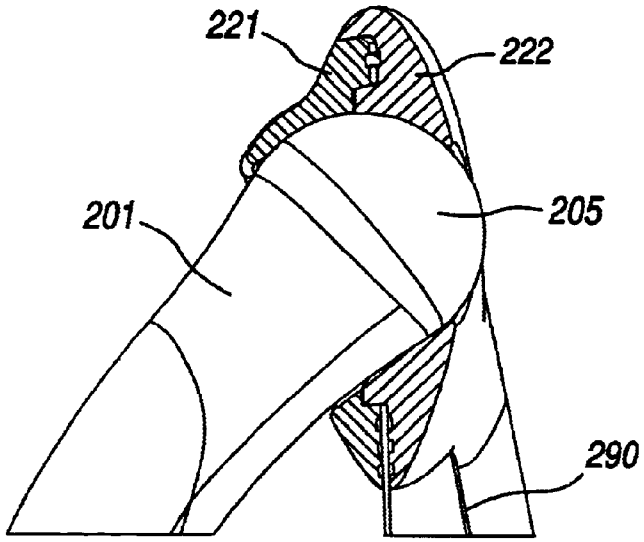
FIG. 24 is an enlarged partial sectional view showing the carrier mounted to the top of the back frame.
Figure 25:
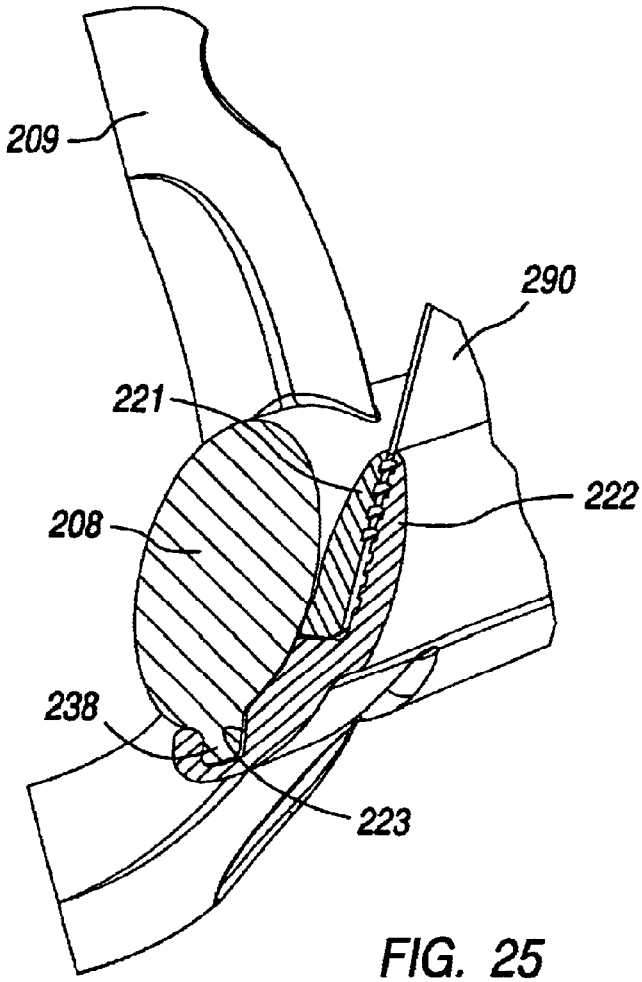
FIG. 25 is an enlarged partial sectional view showing the carrier mounted to the bottom of the back frame.

In order to support the mesh 290 around its edges, the aforementioned carrier 220 is used. The physical connection of the carrier 220 to the mesh 290 may be performed in a number of ways. However, a most reliable connection is disclosed in co-pending U.S. patent application Ser. No. 09/656,491, filed by Timothy P. Coffield on Sep. 6, 2000 and titled "Bonding Strip for Load Bearing Fabric." FIGS. 15, 20, 22 and 23 illustrate a carrier 220 comprising two halves 221 and 222 disposed on opposite sides of the edge portion of mesh 290. The two halves 221 and 222 may, in one form, be formed with internal grooves 224. The halves are placed in a fixture 225 together with an adhesive 226. The adhesive extends through warps and wefts of the fabric 290 and into pockets formed by the grooves 224 and, once cured, creates a mechanical interconnection that is of high strength and durability, and also helps hold the two halves 221/222 of the carrier 200 together. Additional features (not shown) such as screws or the like also may be used to assure the parts to not separate. While halves 221, 222 are shown as approximately equal size in the preferred form, as illustrated in FIGS. 24 and 25, the one side is larger than the other, providing a more pleasing esthetic look to the mounted carrier.

The carrier 220 is formed as a generally rectangular semi-rigid member of resilient, stretchable material. In order to support the carrier 220 with mesh 290, in accordance with the invention and referring once again to FIGS. 2, 6, 20 and 16*a* and 24, the main back frame uprights 201 each has spherical end assemblies portions 205 thereon which are "snap fit" received within circular apertures 227 formed in the upper right and upper left hand corners of the carrier 220. These joints allow upper edge 231 of the carrier 220 to flex allowing the chair back 20 to comfortably conform to the position of the user's shoulders. The back may be secured along bottom edge 232 to the lower transverse frame member 208 by a series of five outwardly depending tabs 238 formed on the bottom of transverse member 208, which tabs fit into complementary recesses 223 formed in lower surface 232. Details of the upper ball and socket connections may be seen in the cross-sectional view of FIG. 24, while the lower attachment construction can be seen in detail in FIG. 25. In assembly, the lower edge 232 is first assembled to the tabs, tension applied to the carrier 220 and the upper openings 227 snapped into the spherical ends 205 of uprights 201.

It can now be appreciated that a chair back construction as just described offers considerable ergonomic advantages. The use of open mesh 290 allows the chair back 20 to not only breathe, but to flex in conformity with the back of the user. The back 20 is also highly cost effective to manufacture and assemble. Further, the back member is positioned on the frame assembly 200 in a manner that keeps the carrier and mesh in tension, providing both flexibility of the back surface but sufficient rigidity for the carrier that it maintains its shape. Because the lower transverse member 208 is curved and set forward of the uprights 201 (via C members 209), the lower end 232 of the carrier assumes a curved configuration that also is spaced forwardly of the uprights 201, so the user never feels the back frame.

As observed the carrier 220 has a slight curvilinear shape from top to bottom so as to assume compressing tension in the mesh fabric. When a user's back contacts the fabric at various locations and during casual movement in the chair. The curvilinear shape also is intended to provide support in the general lumbar region, as best seen in the side view of FIGS. 4*a* and 4*b*.

Furthermore, a major advantage of this tensioned structure is the capability to provide a unique adjustable lumbar support. The back assembly 200 includes a transverse lumbar support tube 250 having gripping means 251 on each of its opposed ends, together with a pair of spaced slide members 253. A cross-section of the gripping means 252 can be seen in FIG. 20 wherein the carrier 220 is provided with a pair of opposed recesses 254 into which opposed projections 255 of the gripping means 252 are slidably received, with the carrier trapped between the projections 255. Thus, the lumbar support tube 251 is slideable on opposed edges of the carrier 220.

Figure 19:
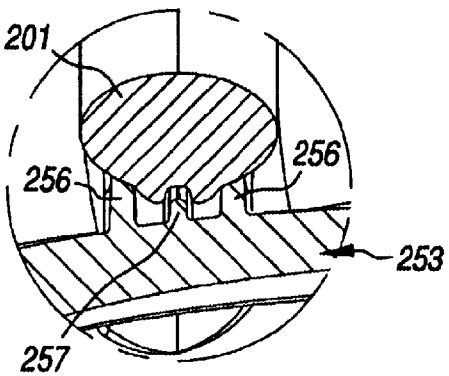
FIG. 19 is an enlarged view of the circled section 19 in FIG. 18.
Figure 18:
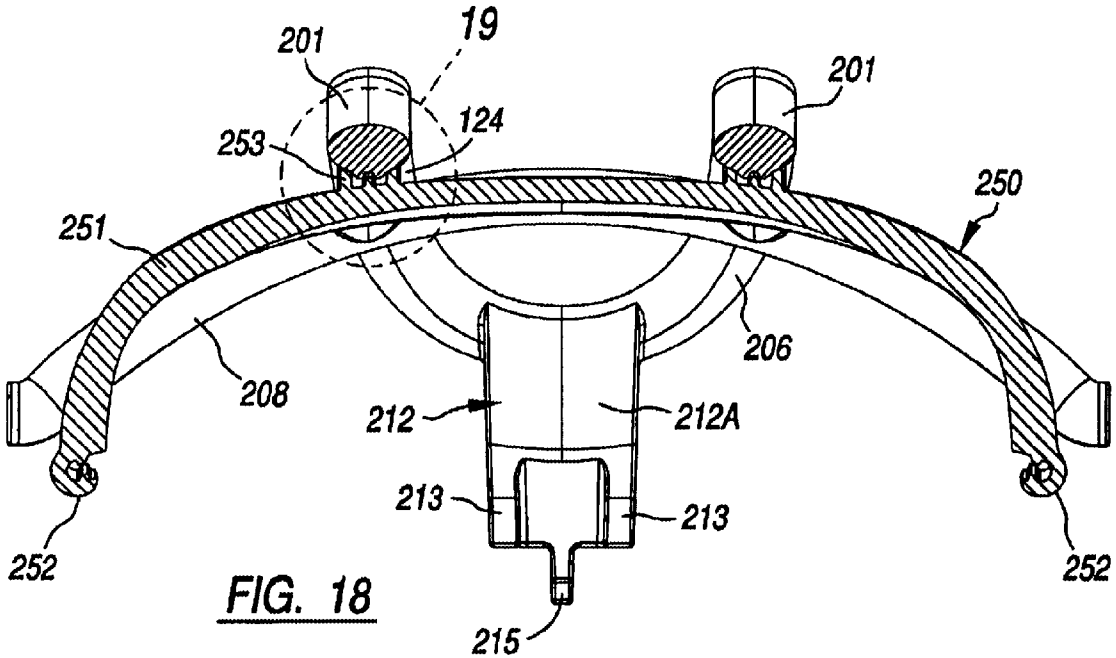
FIG. 18 is a cross-sectional view taken substantially along the line 18—18 in FIG. 15.

FIG. 18 illustrates a cross-sectional view of the support tube taken substantially along the line 18—18 of FIG. 15. There, it can be seen that slide members 253 are configured to engage vertical supports 201. As shown in FIGS. 16*b* and 19, the engagement arrangement of the slide members 253 includes simple vertical grooves 256 formed in the supports 201 and engaging a central rib 257 on the slide member. It can now be appreciated, particularly with reference to FIG. 17, that the lumbar support tube 251 is vertically movable between upper and lower positions as it slides on edges of the carrier 220 by means of the gripping means 252 and also slides on the vertical supports 201 by means of the slide members 253. The result of such movement is to allow the chair user to adjust the vertical height of the lumbar support tube 251 by simple manual manipulation. The lumbar tube 251 is held in proper connection to the supports 201 by the tension of the carrier 220 and mesh 290 without the need for screws, adjustment knobs or the like. In this tension mode the lumbar tube 251 causes the carrier 220 and mesh 290 to be forced forwardly of the chair uprights in the lumbar region of the user, while direct contact of the lumbar support tube 251 with the back of the user is avoided. An in-depth description of this assembly may be found in aforementioned copending application Ser. No. 09/881,795, filed Jun. 15, 2001, incorporated in full by reference.

The vertically adjustable lumbar support member 250 is intended to change the lineal curvature of the carrier 220 as the tube 251 is slide up or down between the carrier 220 and uprights 201. By changing the carrier configuration, no high pressure contact points are placed on the user's back; rather, a taut but flexible mesh is properly positioned for preferred support and comfort, even as the chair reclines.

Turning now to other aspects of a preferred seat 30 developed for use with the ergonomic chair, various aspects of the horizontal seat adjustment and unique cushion arrangement will be described in detail with reference to FIGS. 29–31. The seat plate 330 has been generally described heretofore. The plate 330 is intended to cooperate with a seat pan 301 which has the seat cushion assembly 500 affixed thereto.

The seat pan 301 may be made of any suitable material such as a synthetic resin which may be molded as an integral piece. The seat pan 301 includes an upper portion 304 and a lower portion 305. The upper portion is covered with a cushion assembly 500 described hereinafter and forms the seating surface of the chair 10. The seat pan also includes four spaced L-shaped fingers, 306, 307, 308 and 309 depending from the lower portion 305, a fastener receiving opening 310, a rim 318 around the fastener receiving opening and two abutment elements 312, 313. The seat pan 301 also includes a front portion 314, and a rear portion 315. A large opening 316 is located in the rear portion 315 of the seat pan to accommodate movement of the links 216. Peripheral fastener openings, such as the openings and bosses 317 are provided to fasten the seat cushion assembly 500 to the seat pad 301. The seat pan further includes a number of strengthening ribs such as the rib 318 in the upper portion. Flanking the fastener receiving opening 310 are two depending bumps 319, 320. The fastener receiving opening 310 and the two bumps 319, 320 are formed on a beam 321. Because the material of the seat pan 301 is a synthetic resin, the beam 321 is resilient and thus able to flex in response to any applied force. Such a force may come from the fastener 303 being received through the fastener receiving opening as well as from contact with the seat plate 330 which may provide forces on the two bumps 319, 320. The abutment elements 312, 313 are also formed at the end of respective beams 322, 323 for added flexibility.

The seat plate 330 may be formed as an integral unit of any suitable strong material, such as aluminum. As noted, the seat plate includes a front portion 331, a rear portion 333, a top portion 334 and a bottom portion 335. The seat plate includes four guide slots 336, 337, 338, 339, each with a large head opening and a narrow body opening (FIG. 29), which cooperate with the L-shaped fingers 306, 307, 308, 309, respectively, of the seat pan 301 for restraining and guiding the seat pan 301 in movement in a horizontal direction relative to the fixed seat plate 330.

The seat pan 301 also includes an elongated fastener receiving opening 340 and two abutment limit slots 341, 342. These limit the horizontal movement of the seat pan by limiting the movement of the abutment elements 312 and 313. At the rear portion of the seat plate is a large opening 345 that receives the clevis 212 and links 216. On either side of the elongated fastener receiving opening 340 is a set of recesses 336, 337 in the top portion. The pair of sets of recesses form a detent with the pair of depending bumps 319, 320 on the lower portion of the seat pan. The limit slots 341, 342 receive the abutment elements 312, 313, respectively and limit movement of the seat pad so that the L-shaped fingers do not disengage from the guide slots. The torque limiting fastener 303 is provided for seat adjustment. The design of the fastener 303 is such that once inserted it cannot easily be removed. Details of the fastener are disclosed in the above-mentioned copending application, Application No. 10/077.313, filed on even date herewith, entitled "Adjustable Chair Seat With Locking Mechanism", incorporated herein in full by reference.

In operation the seat pan 301, seat plate 330 and fastener 303 are all formed using well known techniques. Assembly is simple and easy. The seat pan 301 and the seat plate 330 are aligned to allow the L-shaped fingers 306–309 to pass through the enlarged openings at the end of the guide slots 336–339 and for the abutment elements 312, 313 to be pressed into the limit slots 341, 342. Thereafter, the fastener 303 is threaded into the fastener receiving opening 310 of the seat pan 301 with the seat plate 330 sandwiched between. Once the seat pad and the fastener are engaged, they will not separate; however, the fastener 303 may be loosened or tightened simply by rotating the handle clockwise or counterclockwise. When the fastener is loosened, the seat pan may be adjusted generally horizontally relative to the seat plate for the user's comfort. Because of the bumps 319, 320 and recesses 336, 337, a detent is formed which is easily heard and felt by the chair user and this helps in the adjustment process. When the adjustment is complete, the fastener is counter rotated to squeeze the seat pan and the seat plate together.

Another improvement in the ergonomic chair is a highly effective seat cushion assembly.

Figure 32:
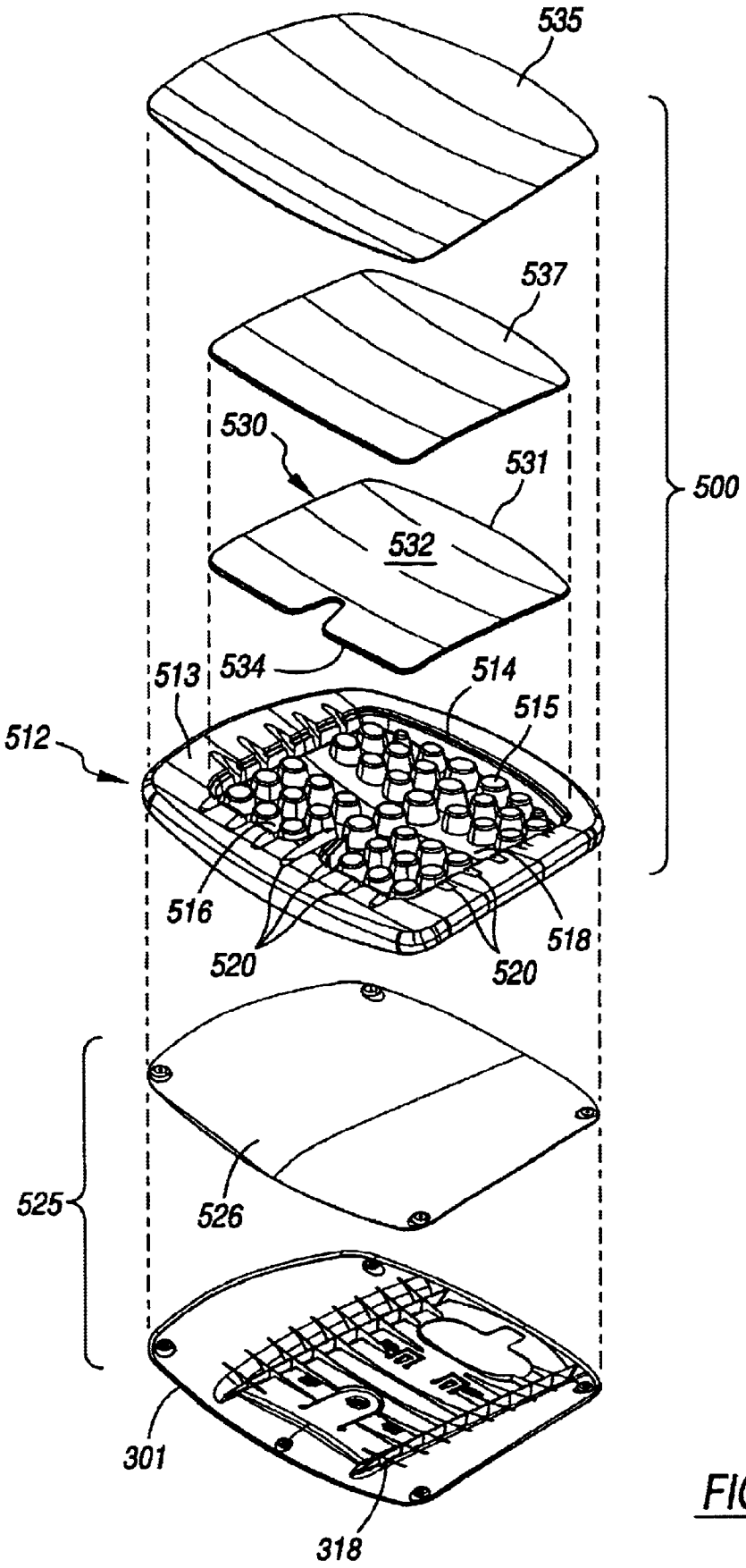
FIG. 32 is an exploded perspective view of a preferred seat cushion assembly of the present invention.
Figure 34:
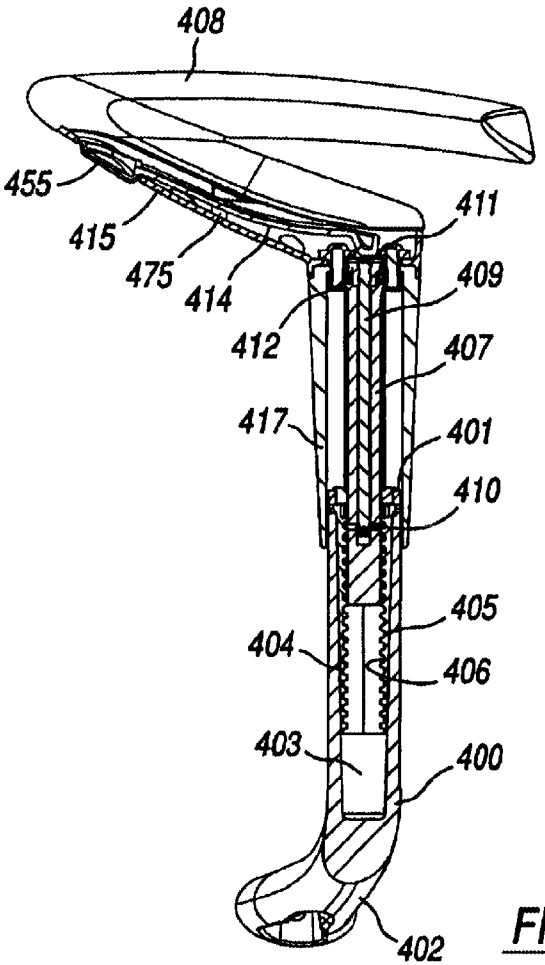
FIG. 34 is a cross-sectional view of the preferred arm assembly taken along the line 34—34 in FIG. 33.
Figure 33:
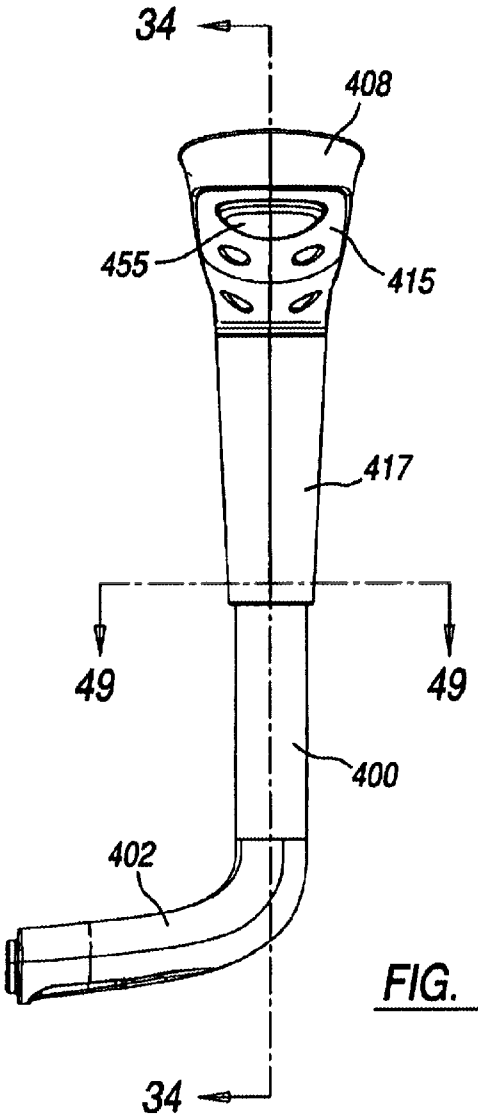
FIG. 33 is a front view of a preferred form of arm assembly for use with the present invention.

FIG. 32 is an exploded view of one embodiment of a seat cushion assembly 500 preferred for use with the chair 10 of the present invention. Seat cushion assembly 500 comprises foam body 512 which can be formed of materials typically used in such seat cushions, such as open-celled or closed-celled polyurethane foam. The foam body 512 has an upper surface 513 and a plurality of vertical columns 515 disposed substantially centrally in the foam body 512. In the illustrated embodiment, the columns 515 extend upwardly such that the top surface of the columns 515 define a curved surface substantially parallel to upper surface 513. In the embodiment illustrated in FIG. 32, the columns 515 are formed integrally with foam body 512. The foam material of which foam body 512 and columns 515 are made will be resiliently deformable to some extent. The columns 515 are structured such that, in the absence of other structural elements of the assembly 500, each column 515 is capable of deflecting substantially independently of the other columns 515 in response to compressive forces applied by a chair user.

The vertical columns 575 are structured so as to define a plurality of air spaces 516 therebetween, which together define a plenum or air reservoir 518. A plurality of channels 520 is disposed within foam body 512 and extend from air reservoir 518 toward the periphery of foam body 512. In the illustrated preferred embodiment of a seat cushion, the channels 520 are directed to the front and lateral sides of the foam body 512.

Design parameters of vertical columns 515 include their number, planar spacing, depth, aspect ratios, and material density and stiffness. Depending on their size and shape, the number of vertical columns is preferably about 40–80. The columns preferably can have a diameter at their lower end in the range of about 1.0–2.0 inches. The columns can have a diameter at their upper end in the range of about 0.9–2.0 inches. The height of the columns can range up to about 4 inches, and most preferably will be in the range of about 0.5–1.5 inches. The columns 515 in the seat cushion 512 can be of different sizes and shapes. The number of air channels 520 will depend upon their size. The total volume capacity of channels 520 will be a function of the volume capacity of air reservoir 518.

The seat cushion assembly 500 further comprises an elastomeric layer 530 that overlays the upwardly extending columns or risers 515. In the illustrated embodiment, the periphery 531 of elastomeric layer 530 is seated within a fitting edge 514 at the upper surface 513 of foam body 512. Elastomeric layer 530 comprises a top surface 532 and a bottom surface 534. The bottom surface 534 of elastomeric layer 530 defines the top surface of air reservoir 518. The elastomeric layer 530 comprises a material having significant resilience and flow properties. Suitable materials for elastomeric layer 530 include, for example, a gelatinous sheet and a polymeric membrane, or other gelatinous materials with variable viscoelastic properties. One suitable material includes a gel sold under the trademark LEVA-GEL® by Royal Medica of Italy. Information about this material is available at www.royalmedica.it. The elastomeric layer 530 and upwardly extending risers or columns 515 are each characterized by both an elastic stiffness value and a dissipative stiffness value In a preferred embodiment of the invention, the ratio of elastic stiffness to dissipative stiffness of the vertical columns 515 is greater than the ratio of elastic stiffness to dissipative stiffness of the elastomeric layer 530.

Depending on the material selected and the properties of the seat cushion desired, elastomeric layer 530 can have a thickness in the preferred range of about 0.2–0.4 inches. The area of elastomeric layer 530 can be less than the area of top surface 513 and most preferably in the range of about 30–55%. In one embodiment, elastomeric layer 530 is about 0.25 inches thick, and has an area of 210 sq. in., relative to a total area of top surface 513 of 392 sq. in.

In use, the foam body 512 of seat cushion assembly 500 is supported by a stiff seat pan 301 rigidly fixed on the seating system assembly 300. The seat pan 301 comprises an inner pan 526 fastened to the seat pan 301.

When a user is seated on a seat cushion of the instant invention, the user's weight is transmitted as vertical compressive forces and transverse shear forces to the user/seat cushion interface. These forces are transmitted through elastomeric layer 530 to vertical columns 515. Elastomeric layer 530 and vertical columns 515 function cooperatively with one another to achieve a self-limiting mechanical response to obtain desired mechanical qualities.

The redistribution of applied forces can be further enhanced by an air-permeable layer 535, disposed above elastomeric layer 530. The air-permeable layer 535 may comprise an open-cell or non-woven viscoelastic material having specified thickness and viscoelastic properties, which air-permeable layer 535 can function to further dissipate applied forces before such forces reach elastomeric layer 530. Optionally, an intermediate foam layer 531 can be placed between air-permeable layer 535 and elastomeric layer 530. A cover fabric, not shown, can overlie the entire seating structure. The layers 512, 530, 535, and the cover fabric can be pre-bonded to one another such as with adhesives. Alternatively, the layers can simply be stacked on top of each other, in which case there should be a sufficient amount of friction between the layers to prevent slippage of the layers with respect to one another in response to shear forces applied during use.

The structure of the instant invention will transmit shear forces emanating at the user/seat interface across the interfaces between each of the layers until elastomeric layer 530. Elastomeric layer 530 will deform viscously in response to applied shear forces, thereby counteracting the shear component of the user's weight by dissipative means, such that the user's skin will not experience the shear component. As a result, the user's tissues will experience substantially only compressive stresses in the normal direction. This reduction in shear stress can reduce the potential for the development of pressure ulcers, and reduce undesirable interference with blood vessel activity in the vicinity of these tissues. Moreover, the unique arrangement and air pressure helps to avoid heat build-up which frequently occurs in chairs and has an advantage over mesh seats which may feel cool and drafty.

When the user leaves the seat cushion of the instant invention, the resiliency of the foam body 512, vertical columns 515 and the elastomeric layer 530 allows fill recovery of both shear and compression deformational mechanisms of the cushion. The passive air pump depressurizes, allowing outside air to pass through the outside cover, the air permeable layer, and optional intermediate foam layer to enter the air reservoir and channels, and open cells in the foam body 512 if open-celled foam is used. The elastomeric layer 530 will also return to its original shape prior to the application of compression and shear forces by a user.

The preferred seat cushion assembly and the advantages thereof are more particularly described in copending application Ser. No. 09/882,503, filed Jun. 15, 2001, entitled "Locking Device for Chair Seat Horizontal Adjustment Mechanism," the disclosure of which is incorporated herein in full by reference.

As previously noted, another aspect of the improved ergonomic chair includes improved arm assemblies 40 that are both vertically adjustable and in which the armrests 408 are rotatable generally in a horizontal plane.

The disclosure herein concentrates on the armrest assemblies which are simply constructed and reliable and allow adjustment both vertically and horizontally. Referring now to FIGS. 33–37, the armrest assembly 40 includes an upstanding support 400 which has an open upper end portion 401, a curved lower end portion 402 and a longitudinally extending opening 403 extending downwardly from the upper end portion. Within the support opening 403 are mounted oppositely disposed liner racks 404, 405, each having a plurality of notches extending in a longitudinal direction. As viewed in FIG. 34, the longitudinal direction is generally vertical.

A guide tube 407 is positioned in the support opening 403 such that the guide tube is generally vertically movable relative to the support. An armrest 408 is mounted to the guide tube so that relative movement of the guide tube causes vertical adjustment of the armrest.

Within the movable guide tube is a elongated element 409 in the form of a rod, the rod being mounted within the guide tube to be rotatable only. As will be explained below, the rod 409 does not slide vertically or longitudinally relative to the guide tube 407. Mounted to the elongated rod 409 is a locking element 410 which is rotatable with the rod to selectively engage and disengage the opposed notches 406 of the liner racks 405, 405. Mounted at an upper end portion 411 of the rod is an activator nut 412 which engages the rod and causes the rod to rotate, the engagement surface of the nut moving between raised and lowered positions (raised in FIG. 35). A spring 413 is mounted between the activator nut and the guide tube and biases the activator nut to the raised position whereby the rod is rotated to and maintained in a locked position. The activator nut is moved by a lever 414 which is operatively connected to the upstanding support by being pivotally mounted to an armrest base 415. A cap 416 is also mounted to the guide tube and is operatively connected to the armrest base to allow the base to rotate in a generally horizontal direction relative to the cap.

The upstanding support 400 has a generally cylindrical shape extending in a generally vertical direction. The lower end portion 402 of the upstanding support curves to a generally horizontal disposition allowing it to be attached to the central base member 100 of the chair 10. The support is made of any suitable material, such as aluminum.

Formed around the upstanding support is a second cylindrical element 417 often referred to as a shroud. The shroud slides along the outside surface of the upstanding support and provides a pleasing aesthetic appearance to the armrest assembly. An upper part 418 of the shroud 417 includes a first horizontal annular bearing surface 419, a vertical annular bearing surface 420 and a second horizontal annular bearing surface 421. These bearing surfaces engage corresponding bearing surfaces of the armrest base 415. The shroud also includes a top flange 422 having fastener receiving openings 423, 424.

As mentioned, within the upstanding support 400 are the two oppositely disposed liner racks 404, 405, with each rack including the plurality of notches 406. The racks have small tabs 425, 426 which engage openings 427, 428 in the upstanding support. In addition to the notches, the racks also include bearing surfaces 429, 430 for the vertically sliding guide tube 407.

The guide tube is generally cylindrical in shape and includes a central opening 431, FIGS. 36–40. The guide tube includes an upper end portion 432 including two fastener openings 433, 434, an annular groove 435 for receiving the spring 413 and two oppositely disposed keys 436, 437. Along an outside surface 438 of the guide tube are grooves, such as the grooves 439, 440, for limiting the upward travel of the guide tube. Toward a lower portion 441 of the guide tube, there are two circumferentially extending slots 442, 443. The slots each extend about an arc of about forty-five degrees. As will be explained below, the locking element 410 extends through the slots to make engagement with the notches 406. When engagement is made, the guide tube 407 and the attached armrest 408 are locked relative to the support 400. The slots 442, 443 also enable the locking element to rotate out of engagement with the notches through the forty-five degree arcs and thereby disengage the guide tube from the support allowing the guide tube to be moved vertically within the support opening 403. In this manner the armrest may be vertically adjusted.

Mounted to the guide tube 407 is the activator nut 412, FIGS. 33, 34, 36, 38 and 40. The activator nut includes an annular flange 444, having a spring retaining surface 445 and key slots, of which one key slot 446 is shown in FIG. 10, to accommodate the keys 436, 437 of the guide tube. The actuator nut also includes a top surface 447 to engage the lever 414 and a central threaded opening 448. The threaded opening engages the rod 409 causing the rod to rotate.

Figure 38:
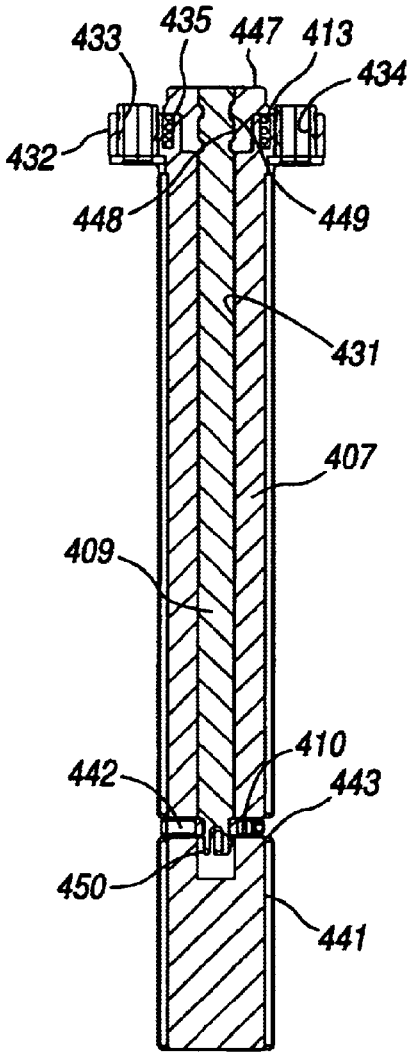
FIG. 38 is an elevation sectional view taken along lines 38—38 of FIG. 36.
Figure 37:
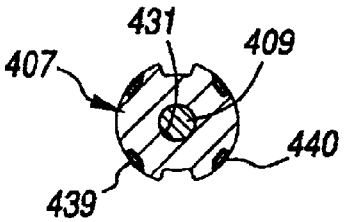
FIG. 37 is a plan sectional view taken along line 37—37 of FIG. 36.
Figure 39:
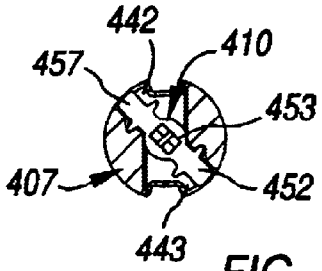
FIG. 39 is a plan sectional view taken along line 39—39 of FIG. 36.
Figure 41:
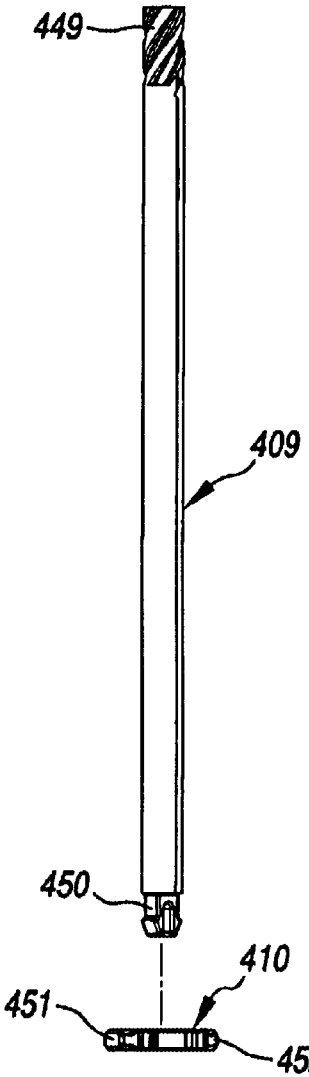
FIG. 41 is an enlarged elevation view of a rod.
Figure 40:
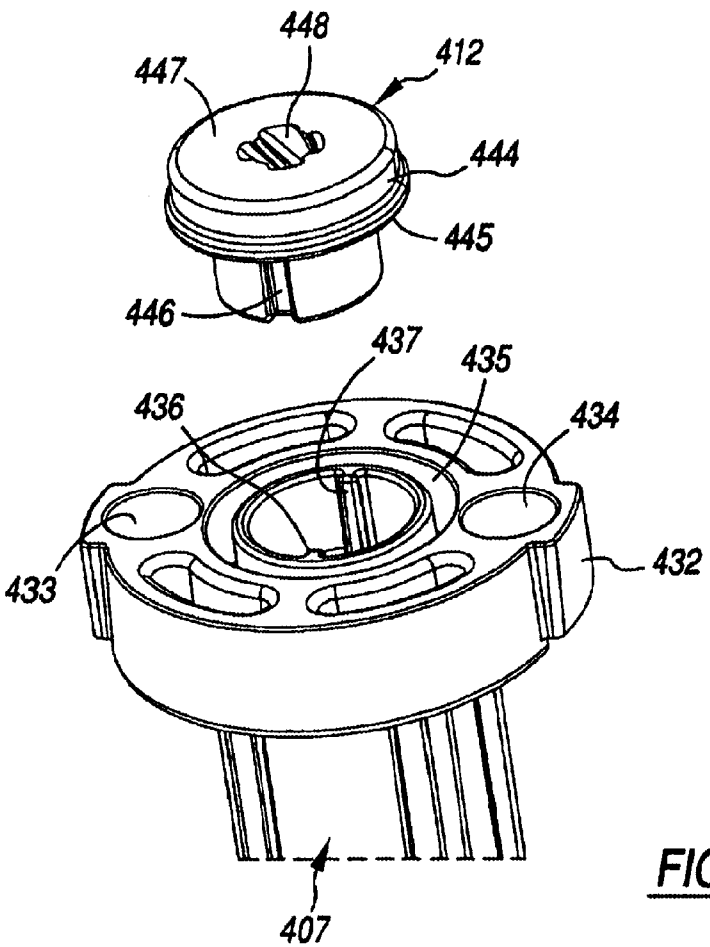
FIG. 40 is an enlarged exploded isometric view of the top of the guide tube and an activator nut.

Mounted within the guide tube is the elongated rod 409, FIGS. 38, 39 and 41. The rod is mounted for rotational movement only and does not slide longitudinally in relation to the guide tube. At an upper end portion 411 of the rod is an external screw thread 449 which engages the internal screw thread 448 of the activator nut. In the lower portion of the rod is a snap fit connector 450 for engaging the locking element 410. The locking element has opposed extending arms 451, 452 and a central opening 453. The locking element central opening receives the snap fit connector of the rod, which deforms and then snaps back into place to make a connection.

Figure 35:
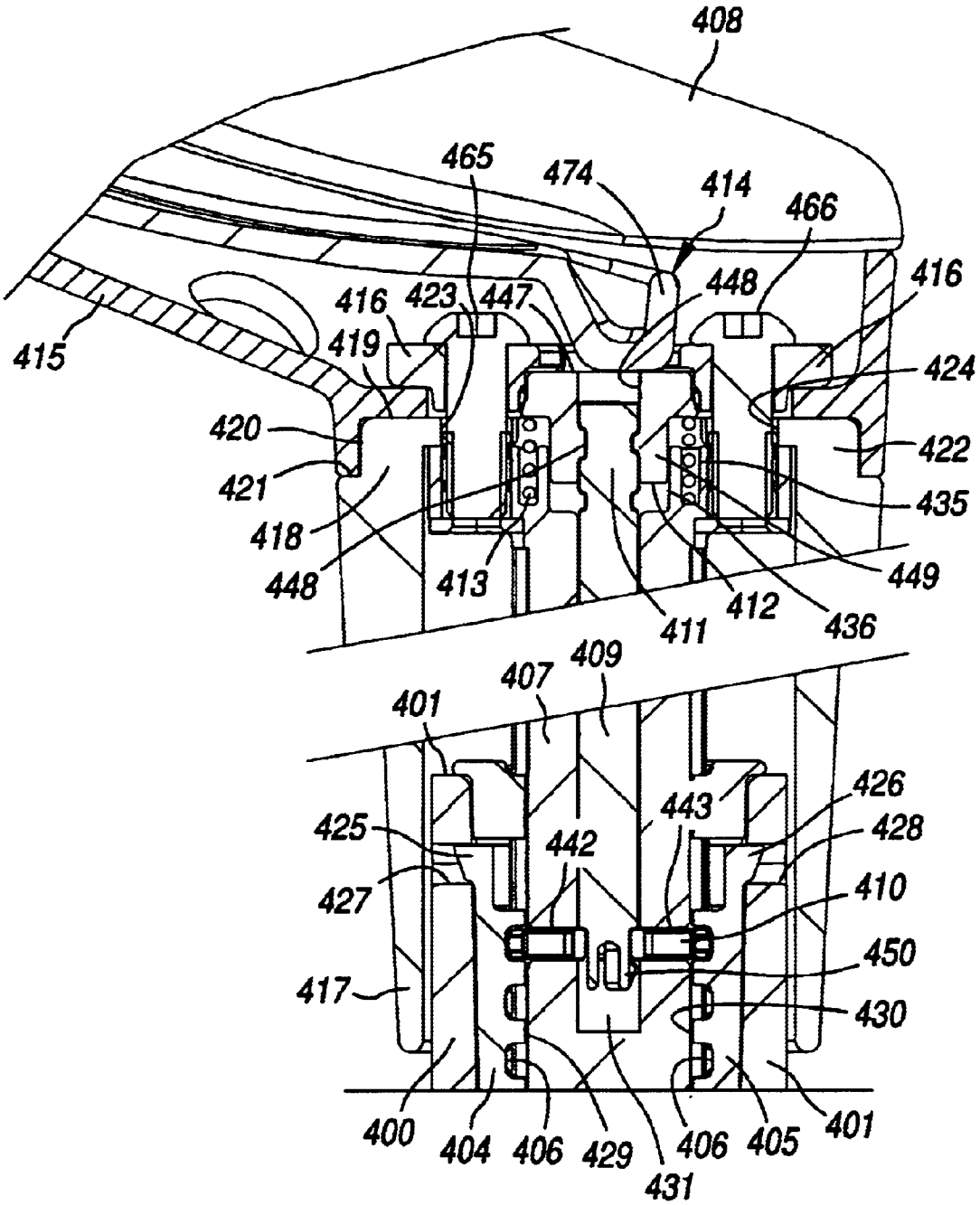
FIG. 35 is an enlarged sectional view, broken away of a portion of the arm assembly as illustrated in FIG. 34, with the armrest in a locked position.
Figure 36:
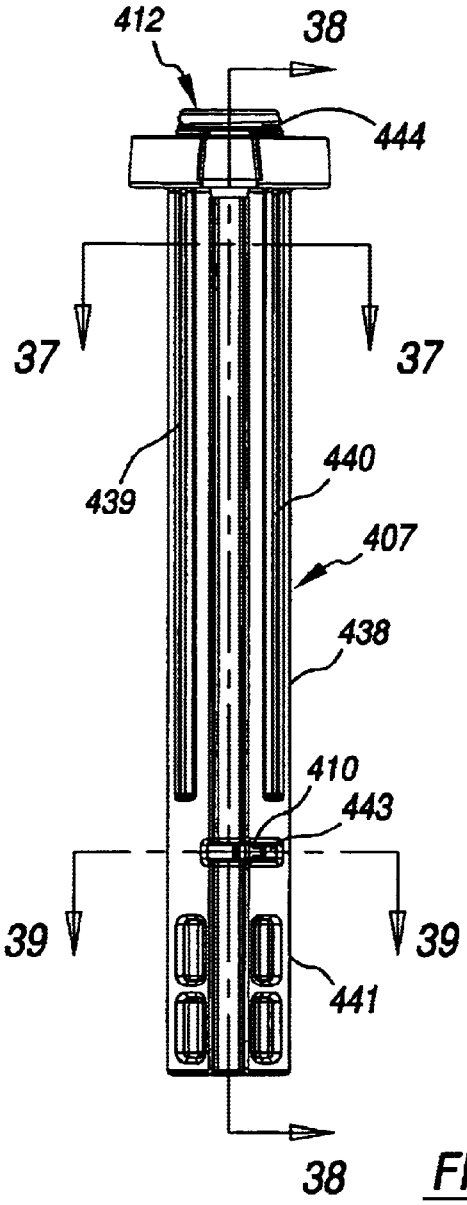
FIG. 36 is an elevation view of a guide tube.

The spring 413 is mounted within the annular groove 435 at the upper end portion 432 of the guide tube 407. An upper end of the spring bears against the surface 445 of the annular flange 444. Because of the keys and key slots, the activator nut moves between raised and lowered positions in a linear fashion as shown in FIG. 35. When the activator nut is moved to its lowered position, the spring is compressed and forms a biasing force against the activator nut tending to return it to its raised position.

Figure 42:
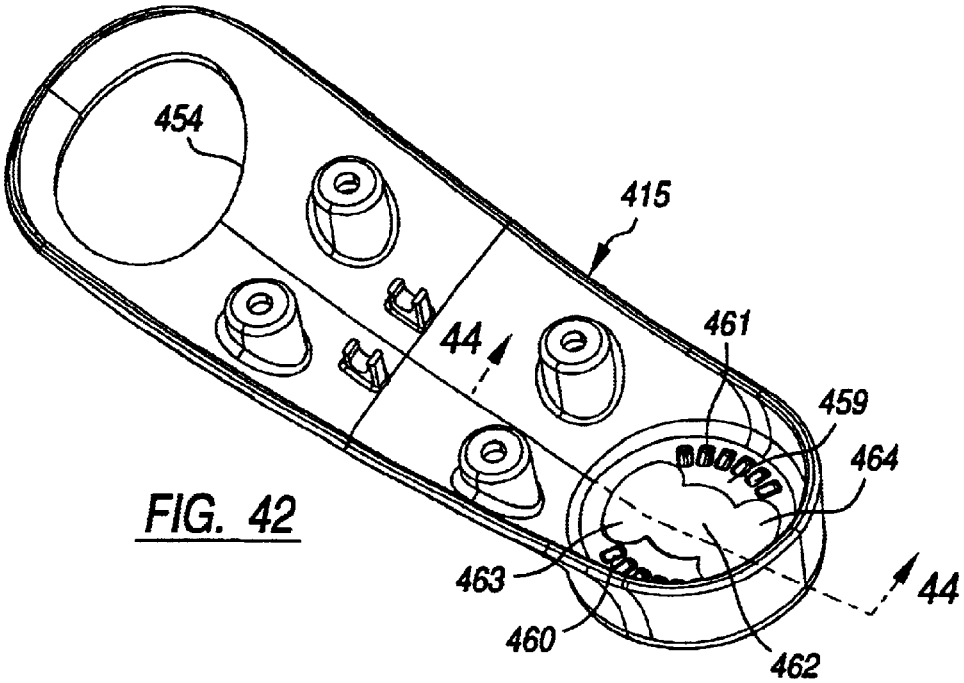
FIG. 42 is a downward looking isometric view of an armrest base.
Figure 43:
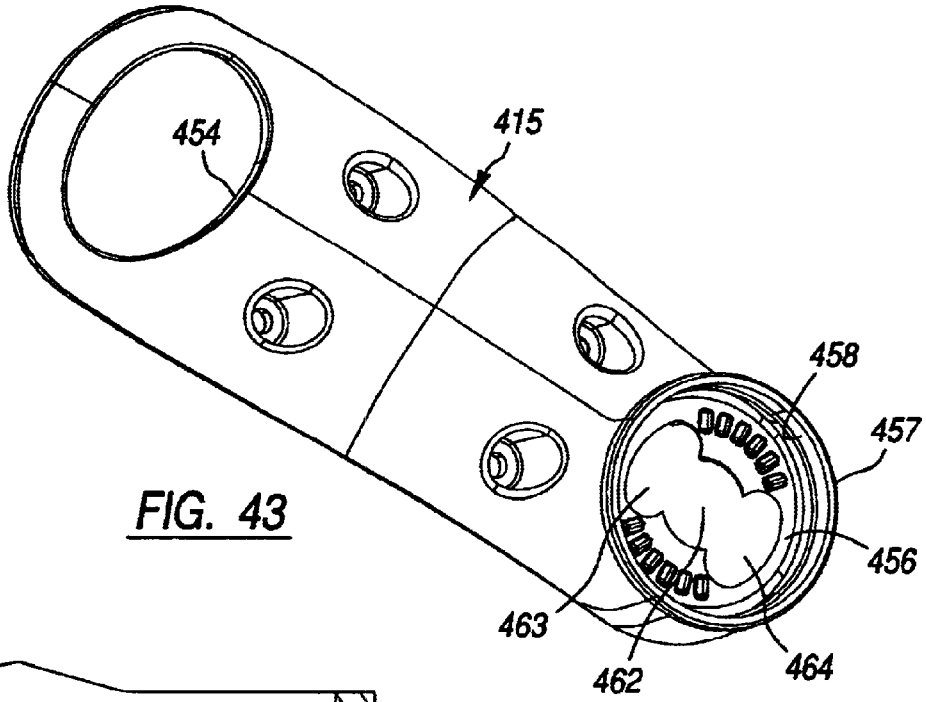
FIG. 43 is an upward looking isometric view of the armrest base.
Figure 44:
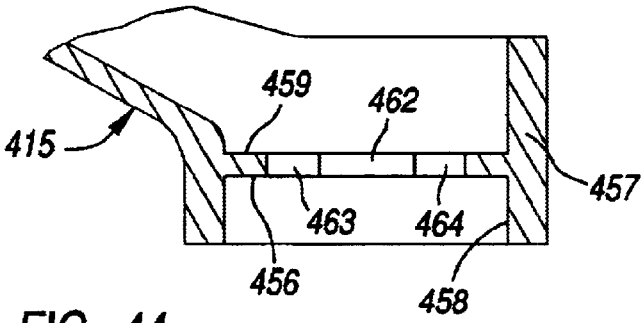
FIG. 44 is a sectional elevation view taken along line 44—44 of FIG. 42.
Figure 48:
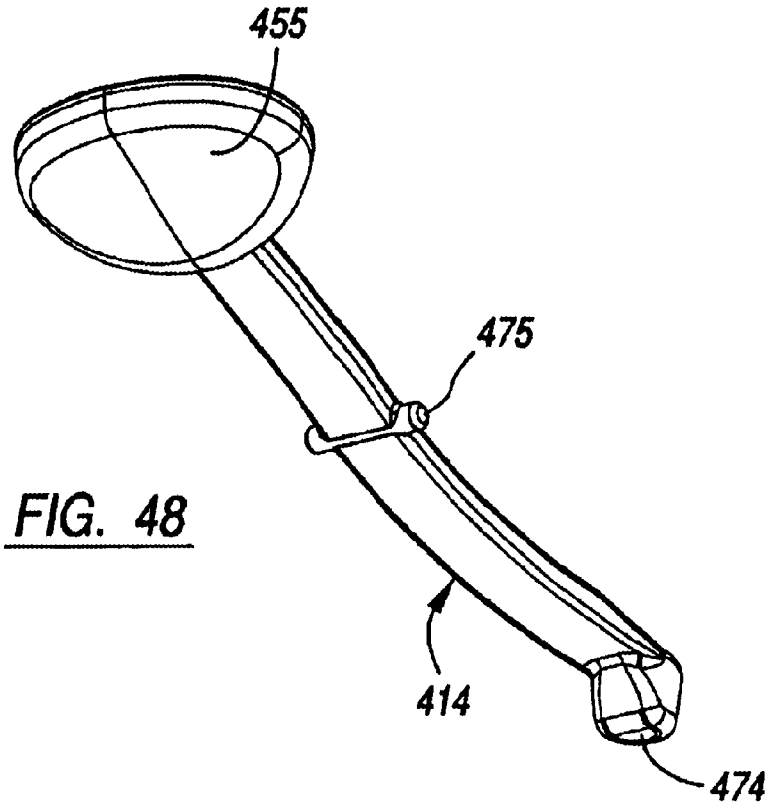
FIG. 48 is an enlarged isometric view of a lever.

Referring now to FIGS. 42–44, the armrest base 415 is shown in more detail. The base is an integral element having a large oval opening 454 at an extended end portion to accommodate a touch pad 455, FIGS. 33 and 48, of the operating lever 414. At the opposite end of the armrest base is a cuplike structure including a bottom bearing surface 456 and a downward projecting flange 457 forming a vertical bearing surface 458 for rotation about the shroud. The armrest base also includes a cup upper surface 459. The upper surface 459 includes two sets of recesses 460, 461, each in a curved format. These recesses form a detent with the cap 416 as will be explained below. The cup bottom also includes an opening having a central portion 462 and two end portions 463, 464. The end portions are curved slots to accommodate two fasteners 465, 466, FIG. 4, allowing the base to pivot until the ends of the slots abut the fasteners. The central portion 462 allows the lever to engage the top surface 447 of the activator nut 412.

Figure 45:
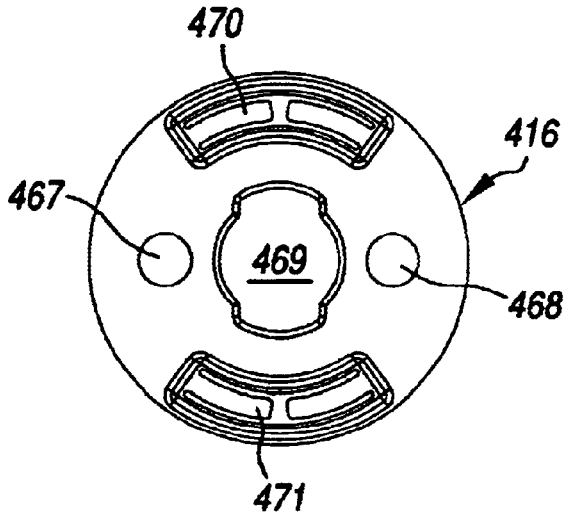
FIG. 45 is a top plan view of a cap.
Figure 46:
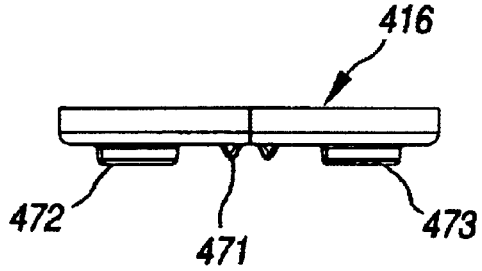
FIG. 46 is an elevation view of the cap.
Figure 47:
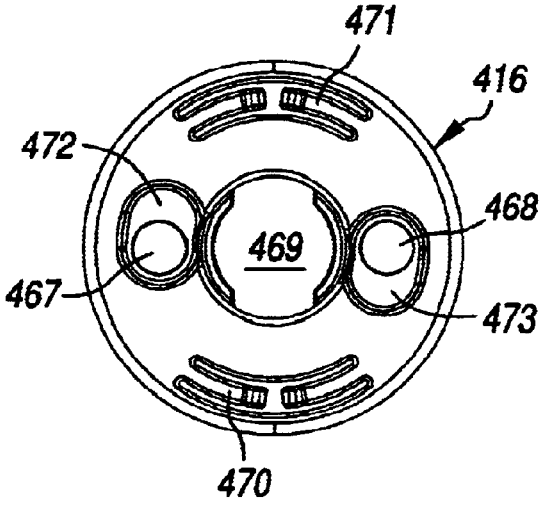
FIG. 47 is a bottom plan view of the cap.

The cap 416 includes two side openings 467, 468, FIGS. 45–47, for receiving the fasteners 465, 466 and a central opening 469 for passing the lever. The side openings are aligned with the end portion slots 463, 464. The cap also includes two sets of resiliently mounted tabs 470, 471. The tabs align with and engage the two sets of curved recesses 460, 461 on the armrest base to form a series of detents. This allows horizontal movement of the armrest base from one detent to another within about a forty-five degree arc determined by the arcs of the end portion slots 463, 464 and depending shoulders 472, 473 surrounding each opening 467, 468, respectively.

Mounted to the armrest base 415 is the lever 414 which extends from the oval opening 454 at one end of the armrest base to the central opening 462 at the other end portion of the armrest base. At the extended end of the lever is the touch pad 455, FIG. 48, while at the other end is a depending projection 474, FIGS. 35 and 48, that makes contact with the upper surface 447 of the activator nut 412. The lever is mounted to pivot about pivot point 475 such that an upward force on the touch pad 455 causes the projection 474 to move downwardly. The downward movement of the lever projection causes the activator nut to move from its raised position to its lowered position thereby causing the rod 409 to rotate and disengage the locking element 410 from the notches 406.

Figure 49:
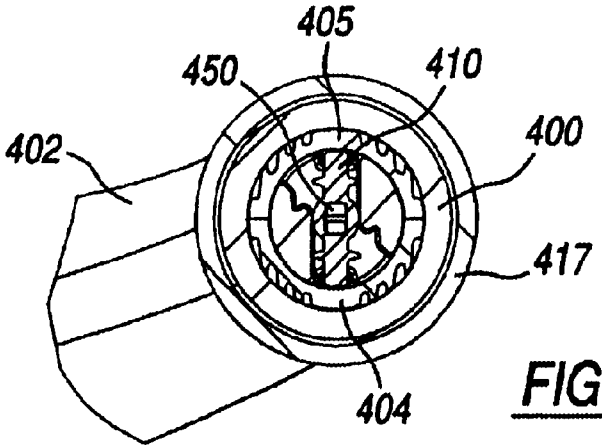
FIG. 49 is a plan sectional view taken along line 49—49 of FIG. 33 showing the armrest in a locked position.
Figure 50:
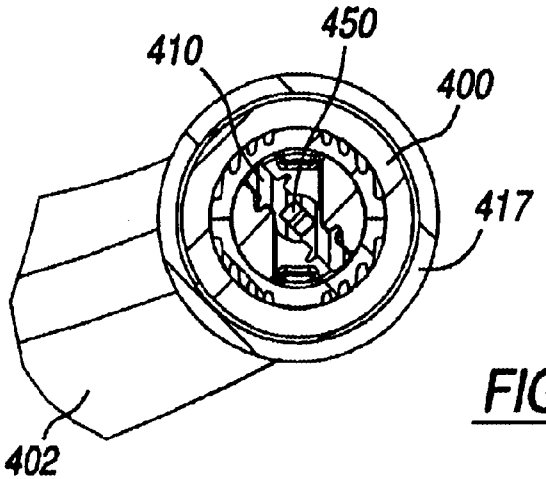
FIG. 50 is a view similar to that shown in FIG. 49 except that the armrest is shown in an unlocked position.

Referring now to FIGS. 49 and 50, the pivoting movement of the locking element 410 is clearly shown. In FIG. 49 the armrest is locked with the locking element engaging the notches 406. When the lever is activated, the locking element is pivoted out of engagement with the notches as shown in FIG. 50.

It can now be appreciated that the armrest assembly is simply constructed, easy to form and assemble and easy to use. In operation, the relative vertical positioning of the armrest, the guide tube and the connected shroud to the upstanding support and the notched liner racks determines the height of the armrest relative to the seat of the chair. Usually the armrest is locked by the locking element engaging a pair of notches. Depressing the lever touch pad causes the projection end to bear down on the top surface of the activator nut. Since the nut cannot rotate, it is depressed causing the threadedly engaged rod to rotate. Rotation of the rod causes the locking element to rotate 45 degrees out of engagement with the pair of notches. The armrest may then be manually adjusted upwardly or downwardly. Once the force on the lever is released, the spring mounted to the guide tube causes the actuator nut to return to its raised position. This linear movement of the activator nut causes reverse rotation of the rod and the locking element causing the locking element to engage a new pair of notches. When this occurs, the armrest is locked in its new position.

Adjusting the armrest in a horizontal direction requires only the movement of the armrest to pivot it outwardly or inwardly within an arc of about 45 degrees. The resiliently mounted tabs of the cap move from one pair of recesses to another pair in the armrest base. This detent mechanism allows the armrest to pivot between six discreet positions. Movement occurs when the force on the armrest is sufficient to move the resilient tabs out of engagement with a pair of recesses.

What has been described is a simply constructed and reliable armrest assembly that is adjustable both vertically and horizontally. These adjustments may be easily made through simple manipulation of portions of the armrest assembly.

It can now be appreciated that a chair 10 constructed according to the invention offers considerable advantages in user comfort by virtue of its synchronous linkage construction particularly where it is used for prolonged periods of time. The chair 10 is also cost effective to manufacture and assemble.

While the present invention has been described in connection with a preferred embodiment, it will be apparent to those skilled in the art that many changes and modifications may be made without departing from the true spirit and scope of the present invention. Accordingly, it is intended by the appended claims to cover all such changes and modifications as come within the spirit and scope of the invention.

What is claimed is:

1. A chair comprising:

support frame means having a forward first support portion and a rear second support portion, said support frame means including a pair of spaced elongated rigid support members connected to opposite sides of a central base module and defining said forward and rear support portions;

a seat member pivotably connected at its forward end to said first forward support portion of said frame means and having a rear support portion;

a backrest member having first and second pivot locations, said first pivot location of said backrest member being pivotably connected to said rear second support portion of said frame means, said backrest member comprising a skeletal frame having a pair of spaced uprights, and a lower transverse member having opposite ends and the rear ends of each of said second support portion being pivotally connected to said transverse frame member; and a link member pivotably connected to said rear support portion of said seat member and pivotably connected to said second pivot location of said backrest member;

wherein tilting movement of said backrest member rearwardly relative to said frame means causes elevation of said rear portion of said seat member upon weight shifting of the chair user and wherein said seat member and said backrest member have a relative center of rotation approximately coincident with the center of rotation of the hip joint of the user.

2. The chair of claim 1 wherein a carrier is attached to said spaced uprights and said transverse member and said carrier includes a fabric backrest attached thereto.

3. The chair of claim 2 further comprising a lumbar member disposed on said skeletal frame and disposed horizontally across the back of said carrier at approximately the lumbar region of a back of a user, said lumbar member being positioned to provide a desired pressure location to help support the back of the user.

4. The chair of claim 3 wherein said lumbar member is height adjustable regardless of the inclination of said chair back.

5. A chair comprising:

support frame means having a forward first support portion and a rear second support portion;

a seat member pivotably connected at its forward end to said first forward support portion of said frame means and having a rear support portion;

a backrest member having first and second pivot locations, said first pivot location of said backrest member being pivotably connected to said rear second support portion of said frame means, said backrest member comprising a fabric of elastic material disposed in a carrier mounted on a skeletal back assembly to provide a support which generally conforms to the back of a user when the chair is in any tilt position; and a link member pivotably connected to said rear support portion of said seat member and pivotably connected to said second pivot location of said backrest member;

wherein tilting movement of said backrest member rearwardly relative to said frame means causes elevation of said rear portion of said seat member upon weight shifting of the chair user and wherein said seat member and said backrest member have a relative center of rotation approximately coincident with the center of rotation of the hip joint of the user.

6. A chair comprising:

support frame means having a forward first support portion and a rear second support portion;

a seat member pivotably connected at its forward end to said first forward support portion of said frame means and having a rear support portion, said seat member including a cushion portion which is independently movable in a relatively horizontal direction relative to said backrest member, whereby a user may configure said seat member in a desired position relative to said back member for greater comfort;

a backrest member having first and second pivot locations, said first pivot location of said backrest member being pivotably connected to said rear second support portion of said frame means; and a link member pivotably connected to said rear support portion of said seat member and pivotably connected to said second pivot location of said backrest member;

wherein tilting movement of said backrest member rearwardly relative to said frame means causes elevation of said rear portion of said seat member upon weight shifting of the chair user and wherein said seat member and said backrest member have a relative center of rotation approximately coincident with the center of rotation of the hip joint of the user.

7. A chair comprising:

support frame means having a forward first support portion and a rear second support portion, said support frame means comprising a transverse central support module, a pair of spaced forwardly extending seat support means carried by said central module and a pair of spaced rearwardly extending backrest support means carried by said module; and a seat member pivotably connected at its forward end to said first forward support portion of said frame means and having a rear support portion;

a backrest member having first and second pivot locations, said first pivot location of said backrest member being pivotably connected to said rear second support portion of said frame means; and a link member pivotably connected to said rear support portion of said seat member and pivotably connected to said second pivot location of said backrest member;

wherein tilting movement of said backrest member rearwardly relative to said frame means causes elevation of said rear portion of said seat member upon weight shifting of the chair user and wherein said seat member and said backrest member have a relative center of rotation approximately coincident with the center of rotation of the hip joint of the user.

8. The chair of claim 7, wherein each said pair of seat support means and back support means comprises a unitary member fixedly secured to said central support module.

9. A chair comprising:

support frame means having a forward first support portion and a rear second support portion;

a seat member pivotably connected at its forward end to said first forward support portion of said frame means and having a rear support portion;

a backrest member having first and second pivot locations, said first pivot location of said backrest member being pivotably connected to said rear second support portion of said frame means;

a link member pivotably connected to said rear support portion of said seat member and pivotably connected to said second pivot location of said backrest member; and a pair of armrests on opposite sides of said seat member, said armrests being height adjustable;

wherein tilting movement of said backrest member rearwardly relative to said frame means causes elevation of said rear portion of said seat member upon weight shifting of the chair user and wherein said seat member and said backrest member have a relative center of rotation approximately coincident with the center of rotation of the hip joint of the user.

10. The chair of claim 1 wherein said seat member in a rest position is inclined downwardly toward the rear of said chair.

11. The chair of claim 10, wherein in a fully upright position of said backrest member said seat member is inclined to the rear of the chair at an angle in a range of between about 10 and 20 degrees from horizontal.

12. The chair of claim 10 wherein in a fully upright position of said backrest member said seat member is inclined to the rear of the chair at an angle of about 15.7 degrees from horizontal.

13. The chair of claim 10 wherein in a fully reclined position of said backrest member said seat member is inclined to the rear of the chair at an angle in a range of between about 6 and 10 degrees.

14. The chair of claim 10 wherein in a fully reclined position of said backrest member said seat member is inclined to the rear of the chair at an angle of about 8.7 degrees from horizontal.

15. The chair of claim 1 wherein the distance between the pivotable connection of said seat member and said first support portion to the pivotable connection of said link member and said rear support of said seat member is in a range of between 10 and 15 inches.

16. The chair of claim 15 wherein the distance between the pivotable connection of said seat member and first support portion to the pivotable connection of said link member and the rear support of said seat member is approximately 12.889 inches.

17. The chair of claim 1 wherein the horizontal distance between said first support portion of said frame means and the upper end of the second rear support portion of the frame means is in a range of between about 12 and 17 inches.

18. The chair of claim 1 wherein the horizontal distance between the first forward support portion of said frame means and the upper end of the second rear support portion of said frame means is approximately 14.5 inches.

19. The chair of claim 1 wherein the distance between the pivotable connections of said link member is in a range of between about 1.5 to 2.5 inches.

20. The chair of claim 19 wherein the distance between the pivotable connections of said link member is about 2.01 inches.

21. The chair of claim 1 wherein the distance between the said second pivot location of said back rest member and said link member pivotable connection thereto is in a range of between about 3 and 6 inches.

22. The chair of claim 21 wherein the distance between said second pivot location of said backrest member and said link member pivotable connection thereto is about 4.7 inches.

23. A chair comprising:

support frame means having a forward first support portion and a rear second support portion;

a seat member pivotably connected at its forward end to said first forward support portion of said frame means and having a rear support portion;

a backrest member having first and second pivot locations, said first pivot location of said backrest member being pivotably connected to said rear second support portion of said frame means;

a link member pivotably connected to said rear support portion of said seat member and pivotably connected to said second pivot location of said backrest member; and at least one extension spring connected between said rear support portion of said seat member and said backrest member, thereby to urge said backrest toward an upright position;

wherein tilting movement of said backrest member rearwardly relative to said frame means causes elevation of said rear portion of said seat member upon weight shifting of the chair user and wherein said seat member and said backrest member have a relative center of rotation approximately coincident with the center of rotation of the hip joint of the user.

24. A tiltable chair comprising:

a base member;

a seat member, said seat member including a cushion comprising an assembly of a rigid seat pan, a foam layer, a plurality of spaced foam risers defining a plenum, an elastomeric member overlying said risers, an air permeable layer overlying said elastomeric layer, and a fabric covering said layers;

a backrest member; and a linkage assembly connecting said seat member and said back member to said base member, said linkage assembly being configured and arranged to allow a rear portion of said seat to rise and concurrently said back member to tilt downwardly and rearwardly, with pivotal movement of said seat member relative to said back member occurring about a pivot axis substantially in alignment with the hip joints of a user.

25. A tiltable chair comprising:

a base member;

a seat member;

a backrest member;

a pair of armrest assemblies disposed on said base member on opposite sides of said seat member, said armrest assemblies remaining in substantially the same attitude regardless of the angle of inclination of said back member or said seat member during tilting of said chair; and a linkage assembly connecting said seat member and said back member to said base member, said linkage assembly being configured and arranged to allow a rear portion of said seat to rise and concurrently said back member to tilt downwardly and rearwardly, with pivotal movement of said seat member relative to said back member occurring about a pivot axis substantially in alignment with the hip joints of a user.

26. The chair of claim 25 wherein each said armrest is rotatable about an axis adjacent a corresponding side edge portion of the back, said axes being positioned for approximate alignment with the elbows of a user having forearms resting on said armrests.

27. A tiltable chair comprising:

a base member;

a seat member;

a backrest member, said backrest member comprising a skeletal frame having a carrier affixed thereto, said carrier having a fabric disposed therein for contact with the back of the user; and a linkage assembly connecting said seat member and said back member to said base member, said linkage assembly being configured and arranged to allow a rear portion of said seat to rise and concurrently said back member to tilt downwardly and rearwardly, with pivotal movement of said seat member relative to said back member occurring about a pivot axis substantially in alignment with the hip joints of a user.

28. A tiltable chair comprising:

a base member;

a seat member;

a backrest member;

a height adjustable lumbar member positioned horizontally across said back member at approximately the lumbar region of a back of a user, said lumbar member being height adjustable by the user; and a linkage assembly connecting said seat member and said back member to said base member, said linkage assembly being configured and arranged to allow a rear portion of said seat to rise and concurrently said back member to tilt downwardly and rearwardly, with pivotal movement of said seat member relative to said back member occurring about a pivot axis substantially in alignment with the hip joints of a user.

29. The chair of claim 25 and further including a pair of height adjustable armrests adapted to rotate laterally in a substantially horizontal plane to accommodate the angle at which the forearms of a user are positioned.

30. A tiltable chair comprising:

a base member;

a seat member;

a backrest member;

adjustable tilt limiting means whereby the user may selectively predetermine the maximum amount of inclination of said chair back; and a linkage assembly connecting said seat member and said back member to said base member, said linkage assembly being configured and arranged to allow a rear portion of said seat to rise and concurrently said back member to tilt downwardly and rearwardly, with pivotal movement of said seat member relative to said back member occurring about a pivot axis substantially in alignment with the hip joints of a user.

* * * * *